US010906307B2

(12) United States Patent
Ikeuchi et al.

(10) Patent No.: US 10,906,307 B2
(45) Date of Patent: Feb. 2, 2021

(54) LIQUID DISCHARGE HEAD AND RECORDING APPARATUS USING THE SAME

(71) Applicant: KYOCERA Corporation, Kyoto (JP)

(72) Inventors: Wataru Ikeuchi, Kirishima (JP); Yifei Jiao, Changning (CN)

(73) Assignee: KYOCERA CORPORATION, Kyoto (JP)

( * ) Notice: Subject to any disclaimer, the term of this patent is extended or adjusted under 35 U.S.C. 154(b) by 0 days.

(21) Appl. No.: 16/634,006

(22) PCT Filed: Jul. 25, 2018

(86) PCT No.: PCT/JP2018/027946
§ 371 (c)(1),
(2) Date: Jan. 24, 2020

(87) PCT Pub. No.: WO2019/022154
PCT Pub. Date: Jan. 31, 2019

(65) Prior Publication Data

US 2020/0207091 A1 Jul. 2, 2020

(30) Foreign Application Priority Data

Jul. 26, 2017 (JP) ..... 2017-144618

(51) Int. Cl.
*B41J 2/14* (2006.01)

(52) U.S. Cl.
CPC .. *B41J 2/14201* (2013.01); *B41J 2002/14419* (2013.01)

(58) Field of Classification Search
CPC ..... B41J 2/1433; B41J 2/162; B41J 2002/14475; B41J 2/14201; B41J 2002/14419; B41J 2/14; B41J 2/155
See application file for complete search history.

(56) References Cited

U.S. PATENT DOCUMENTS

2013/0083106 A1* 4/2013 Tsukamoto ..... B41J 2/04596 347/10
2015/0224766 A1* 8/2015 Kawamura ..... B41J 2/1433 347/9
2017/0246865 A1* 8/2017 Hirabayashi ..... B41J 2/04586

FOREIGN PATENT DOCUMENTS

JP 2009-143168 A 7/2009

* cited by examiner

*Primary Examiner* — Kristal Feggins
(74) *Attorney, Agent, or Firm* — Volpe Koenig

(57) ABSTRACT

A liquid discharge head according to the present disclosure includes a plurality of discharge holes, a plurality of pressure applying chambers, a flow path member including a plurality of common flow paths, and a plurality of pressure applying modules. Adjacent discharge hole groups have a part in which, when a discharge hole A is positioned in an n column in one of the discharge hole groups, a discharge hole B in the discharge hole group located adjacent with the common flow path interposed therebetween is positioned in an n±1 column. A discharge hole C in the discharge hole group located at a center in a second direction is positioned in an n column, while a non-carry discharge hole is positioned in an n±1 column.

13 Claims, 9 Drawing Sheets

LIQUID DISCHARGE HEAD AND RECORDING APPARATUS USING THE SAME

CROSS-REFERENCE TO RELATED APPLICATIONS

This application is national stage application of International Application No. PCT/JP2018/027946, filed on Jul. 25, 2018, which designates the United States, incorporated herein by reference, and which claims the benefit of priority from Japanese Patent Application No. 2017-144618, filed on Jul. 26, 2017, the entire contents of both of which are incorporated herein by reference.

FIELD

The present disclosure relates to a liquid discharge head and a recording apparatus using the same.

BACKGROUND

As conventional printing heads, for example, there is a known liquid discharge head that discharges a liquid onto a recording medium so as to execute various types of printing. In the liquid discharge head, for example, a large number of discharge holes for discharging the liquid are provided and spread in two dimensions. The liquids discharged from the respective discharge holes are dropped side by side onto the recording medium so that the printing is executed (for example, see Patent Literature 1).

CITATION LIST

Patent Literature

Patent Literature 1: Japanese Laid-open Patent Publication No. 2009-143168

SUMMARY

A liquid discharge head according to the present disclosure includes a plurality of discharge holes, a plurality of pressure applying chambers, a flow path member including a plurality of common flow paths, and a plurality of pressure applying modules. The plurality of pressure applying chambers are connected to respective discharge holes of the plurality of discharge holes. The plurality of pressure applying modules apply a pressure to respective pressure applying chambers of the plurality of pressure applying chambers. In a planar view, the plurality of common flow paths extend in a first direction, and are arranged in a row in a second direction that is perpendicular to the first direction. The plurality of discharge holes include a plurality of discharge hole groups arranged in a row in the second direction, and configured to be provided between adjacent common flow paths of the plurality of common flow paths; and a non-carry discharge hole that is not provided between the common flow paths. Adjacent discharge hole groups of the plurality of discharge hole groups have a part in which, when a discharge hole A is positioned in an n column in one of the discharge hole groups, a discharge hole B in the discharge hole group located adjacent with the common flow path interposed therebetween is positioned in an n±1 column. A discharge hole C in the discharge hole group located at a center in the second direction is positioned in an n column, while the non-carry discharge hole is positioned in an n±1 column.

A recording apparatus according to the present disclosure includes the liquid discharge head above-described, a conveying module that conveys a recording medium to the liquid discharge head, and a controller that controls the liquid discharge head.

DESCRIPTION OF EMBODIMENTS

Figure 1A:
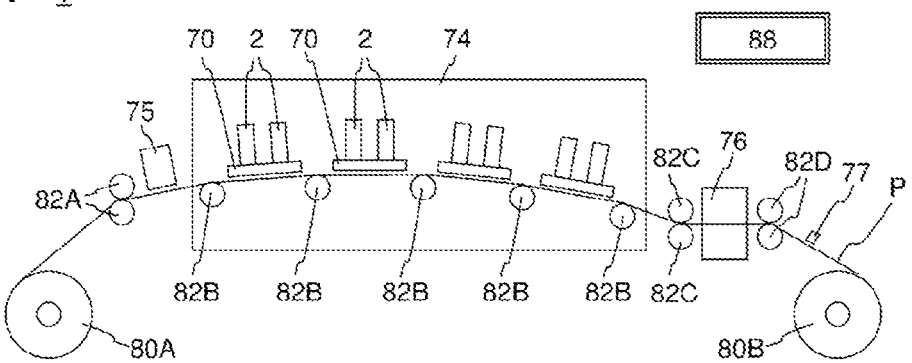
FIG. 1A is a side view of a recording apparatus including a liquid discharge head according to embodiments of the present disclosure and FIG. 1B is a plan view of a recording apparatus including a liquid discharge head according to embodiments of the present disclosure.

FIG. 1A is a schematic side view of a color ink-jet printer 1 (hereinafter sometimes simply referred to as a printer) that is a recording apparatus including a liquid discharge head 2 according to embodiments of the present disclosure, and FIG. 1B—is a schematic plan view. The printer 1 includes: the liquid discharge head 2 that discharges a liquid; and a moving module that moves a recording medium relative to the liquid discharge head 2. In the printer 1, the moving module is, for example, each conveyance roller such as conveyance rollers 82A, 82B, 82C, 82D and a motor that drives them. The moving module conveys a print sheet P, which is a recording medium, from the conveyance rollers 82A to the conveyance rollers 82C. A controller 88 controls the liquid discharge head 2 based on, for example, print data that is image and/or text data so as to cause the liquid to be discharged to the print sheet P and cause the liquid to be dropped onto the print sheet P, thereby executing recording, such as printing, on the print sheet P.

According to embodiments, the liquid discharge head 2 is fixed to the printer 1, and the printer 1 is what is called a line printer. The recording apparatus according to embodiments includes what is called a serial printer in which the liquid discharge head 2 is moved back and forth in a direction that intersects with the conveying direction of the print sheet P, e.g., a substantially perpendicular direction, and in the process, the operations to discharge the liquid and to convey the print sheet P are alternately performed. In the serial printer, the moving module includes: a carriage including the liquid discharge head 2; and a motor that moves the carriage back and forth in a direction that intersects with the conveying direction of the print sheet P. Examples of the moving module include, but are not limited to, a roller that conveys the print sheet P, a motor that drives the roller, etc.

In the printer 1, four flat-plate like head-mounted frames 70 (hereinafter sometimes simply referred to as frames) are secured such that they are substantially parallel to the print sheet P. Each of the frames 70 has five undepicted holes so that the five liquid discharge heads 2 are mounted at the respective hole parts. The five liquid discharge heads 2 mounted on one of the frames 70 constitute one head group 72. The printer 1 includes the 4 head groups 72, and the 20 liquid discharge heads 2 are mounted in total.

The part of the liquid discharge head 2, mounted on the frame 70, for discharging the liquid is opposed to the print sheet P. The distance between the liquid discharge head 2 and the print sheet P is, for example, approximately 0.5 to 20 mm.

The 20 liquid discharge heads 2 may be directly connected to the controller 88 or may be connected via a distributor that distributes print data. For example, the distributor may distribute print data transmitted from the controller 88 to the 20 liquid discharge heads 2. For example, four distributors corresponding to the four head groups 72 may be used so that each of the distributors distributes print data, transmitted from the controller 88 to the four distributors, to the five liquid discharge heads 2 within the corresponding head group 72.

Figure 1B:
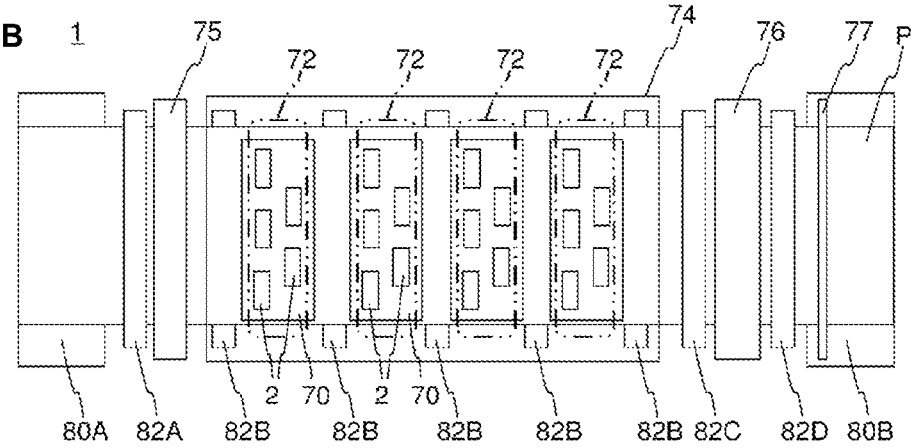

The liquid discharge head 2 has an elongated shape that is elongated in the direction from the front to the back in FIG. 1A, a vertical direction in FIG. 1B. In the single head group 72, the three liquid discharge heads 2 are arranged in a direction that intersects with the conveying direction of the print sheet P, e.g., a substantially perpendicular direction. The other two liquid discharge heads 2 are provided at different positions along the conveying direction, each of which is arranged between the two adjacent liquid discharge heads 2 out of the three liquid discharge heads 2. In other words, the liquid discharge heads 2 are arranged in a staggered manner in the single head group 72. The liquid discharge heads 2 are provided such that the printable range of each of the liquid discharge heads 2 is connected in a direction that intersects with the conveying direction of the print sheet P, that is, a width direction of the print sheet P, or their ends are overlapped with each other, whereby gapless printing in the width direction of the print sheet P is possible.

The four head groups 72 are arranged in the conveying direction of the print sheet P. Liquid, e.g., ink, is supplied from an undepicted liquid supply tank to each of the liquid discharge heads 2. The same color ink is supplied to the liquid discharge heads 2 belonging to the single head group 72 so that the four head groups 72 enable printing in four color inks. The colors of inks discharged from the respective head groups 72 are, for example, magenta (M), yellow (Y), cyan (C), and black (K). Printing in the inks controlled by the controller 88 enables printing of color images.

The degree of viscosity of the liquid contained in the liquid supply tank for printing is set to be, for example, equal to or more than 5 mPa·s and equal to or less than 15 mPa·s. The liquid supply tank may include a stirrer that stirs the contained liquid so as to prevent an increase in the degree of viscosity of the liquid or prevent sinking of a component, etc.

In the printer 1, the liquid that has not been discharged from the liquid discharge head 2 may be collected from the liquid discharge head 2. The collected liquid may be returned to the liquid supply tank that supplies the liquid to the liquid discharge head 2 or may be accumulated in a liquid collection tank. The liquid accumulated in the liquid collection tank may be used for printing as appropriate after the liquid is passed through a filter, the degree of viscosity is adjusted, or the like.

The number of the liquid discharge heads 2 mounted in the printer 1 may be one as long as there is one color and the printable range is printed by the single liquid discharge head 2. The number of the liquid discharge heads 2 included in the head group 72 or the number of the head groups 72 may be changed as appropriate in accordance with the print target or the print condition. For example, the number of the head groups 72 may be increased for printing in more colors. If the multiple head groups 72 are arranged for printing in the same color alternately in the conveying direction, the conveying speed may be increased even with the use of the liquid discharge heads 2 having the same performance. Thus, the print area per hour may be increased. The multiple head groups 72 are provided for printing in the same color and arranged at different positions in the direction that intersects with the conveying direction, whereby the resolution in the width direction of the print sheet P may be improved.

In addition to color ink printing, a liquid such as a coating agent for surface processing on the print sheet P may be printed by the liquid discharge head 2 uniformly or with patterning. As the coating agent, it is possible to use, for example, the one for forming a liquid absorbing layer for easy liquid fixing in case of the use of a recording medium having a low liquid permeability. Alternatively, as the coating agent, it is possible to use the one for forming a liquid-permeability suppression layer that prevents the liquid from spreading too much or prevents the liquid from mixing too much with other liquids dropped in the neighborhood in case of the use of a recording medium having a high liquid permeability. Instead of being printed by the liquid discharge head 2, the coating agent may be coated uniformly by an applicator 75 controlled by the controller 88.

The printer 1 executes printing on the print sheet P that is a recording medium. The print sheet P is wound around a sheet feeding roller 80A and, after being delivered from the sheet feeding roller 80A, the print sheet P is passed under the liquid discharge heads 2 mounded on the frames 70 and is then passed between the two conveyance rollers 82C to be finally collected by a collection roller 80B. During printing, the conveyance rollers 82C are rotated so that the print sheet P is conveyed at a constant speed and printing is executed by the liquid discharge head 2.

Then, the printer 1 is described in detail in order of conveying the print sheet P. After the print sheet P is delivered from the sheet feeding roller 80A, it is passed between the two conveyance rollers 82A and is then passed under the applicator 75. The applicator 75 applies the above-described coating agent to the print sheet P.

Then, the print sheet P enters a head chamber 74 housing the frames 70 on which the liquid discharge heads 2 are mounted. Generally, the head chamber 74 is a space isolated from outside although it is connected to outside through a part such as the part through which the print sheet P enters or leaves. A control factor, such as temperature, humidity, and atmospheric pressure, of the head chamber 74 is controlled by the controller 88, or the like, as appropriate. As the head chamber 74 is less affected by disturbance as compared with the outside where the printer 1 is placed, the variation range of the above-described control factor may be narrower than that of the outside.

The head chamber 74 includes the five conveyance rollers 82B so that the print sheet P is conveyed above the conveyance rollers 82B. The five conveyance rollers 82B are provided such that, when viewed from the side, they form a protrusion at the center along the direction in which the frames 70 are mounted. Thus, the print sheet P conveyed above the five conveyance rollers 82B has an arc-like shape when viewed from the side, and the tension applied to the print sheet P causes the print sheet P between the conveyance rollers 82B to have a planar shape. One of the frames 70 is disposed between the two conveyance rollers 82B. The installation angle of each of the frames 70 is gradually changed such that it is parallel to the print sheet P conveyed under it.

After the print sheet P comes out of the head chamber 74, it is passed through the two conveyance rollers 82C, passed through a dryer 76, passed between the two conveyance rollers 82D, and collected in the collection roller 80B. The conveying speed of the print sheet P is, for example, 100 to 200 m/minute. Each roller may be controlled by the controller 88 or may be manually operated by a person.

Drying by the dryer 76 may prevent the wound and overlapped print sheets P from adhering to each other or prevent an undried liquid from being scraped in the collection roller 80B. High-speed printing requires high-speed drying. For high-speed drying, the dryer 76 may use multiple drying methods in sequence for drying or may use multiple drying methods in combination for drying. Examples of the drying method used for such a case include, but are not limited to, hot air blowing, infrared irradiation, contact with a heated roller, etc. In the case of infrared irradiation, infrared rays in a specific frequency range may be applied so as to enable less damage to the print sheet P and high-speed drying. When the print sheet P is brought into contact with the heated roller, the print sheet P may be conveyed along the cylindrical surface of the roller so as to increase the time in which the heat is transferred. The conveyance range is preferably equal to or more than ¼ of the circumference, more preferably equal to or more than ½ of the circumference. In the case of printing with UV curing ink, or the like, a UV irradiation light source may be provided instead of the dryer 76 or in addition to the dryer 76. The UV irradiation light source may be provided between the frames 70.

After the printed liquid is dried or hardened so that the print sheet P may be collected by the collection roller 80B, it is captured by an imaging module 77 to check the print status. The print status may be checked by printing of a test pattern or printing of the target print data to be printed out. The capturing may be executed while the print sheet P is conveyed, i.e., printing is executed on other parts of the print sheet P, or while it is stopped after being conveyed.

The captured imaging data is evaluated by the controller 88 as to whether there is an unprinted area or an area with a low printing accuracy. Specifically, it is evaluated as to whether there is an unprinted pixel due to the failure to discharge the liquid, whether the discharge amount, the discharge velocity, or the discharge direction of the discharged liquid is different from the target value, whether the ejected liquid is dropped on a different position due to the effect of a gas flow, or the like, or the spreading of a pixel after dropping is small or large.

When a difference, or the like, of more than a set threshold is detected from imaging data, the controller 88 may notify a result. In the middle of printing, the printing may be stopped, or the printing to be resumed may be canceled.

The controller 88 may modify the print data so as to correct the difference detected from the imaging data and cause the liquid discharge head 2 to discharge the liquid based on the modified print data. Specifically, when there is an unprinted pixel, a small-sized pixel, or a pixel with a low density, the controller 88 may generate the print data and execute printing with an increased amount of liquid to be dropped in the neighborhood of the pixel as compared with the original print data. Similarly, when there is a large-sized pixel or a pixel with a high density, the print data for a decreased amount of liquid to be dropped in the neighborhood of the pixel may be generated. When the dropping position is shifted in a certain direction, the print data may be generated such that the amount of liquid to be dropped in the neighborhood in the shifted direction is decreased and the amount of liquid to be dropped in the neighborhood in the direction opposite to the shifted direction is increased. The modification range of print data may be a wider range in addition to the pixels adjacent to the pixel for which a shift has been detected.

The printer 1 may include a cleaning module that cleans the liquid discharge head 2. The cleaning module executes for example wiping and/or capping while cleaning. During the wiping, for example, a flexible wiper scrapes the surface of a portion for discharging the liquid, e.g., a discharge-hole surface 4-2 described later, to remove the liquid adhering to the surface. For example, capping while cleaning is executed as described below. A cap is placed (this is called capping) over a portion for discharging the liquid, e.g., the discharge-hole surface 4-2 described later so that the discharge-hole surface 4-2 and the cap form a substantially sealed space. The liquid is repeatedly discharged in the above-described state to remove the liquid having a higher degree of viscosity than that in the normal state, a foreign matter, or the like, stuck in a discharge hole 8. Capping may prevent the liquid in the middle of cleaning from being scattered in the printer 1 and prevent the liquid from adhering to the print sheet P or a conveying mechanism such as a roller. The cleaned discharge-hole surface 4-2 may be further wiped. Wiping and capping while cleaning may be executed when a person manually operates a wiper or a cap attached to the printer 1 or may be executed automatically by the controller 88.

The recording medium may be roll-shaped cloth, or the like, as well as the print sheet P. Instead of directly conveying the print sheet P, the printer 1 may directly convey a conveyance belt so that the recording medium placed on the conveyance belt may be conveyed. Thus, the recording medium may be sheets of paper, cut cloth, wood, tile, or the like. The liquid discharge head 2 may discharge the liquid including conductive particles to print a wiring pattern of an electronic device. The liquid discharge head 2 may discharge a predetermined amount of liquid chemical agent or the liquid including a chemical agent toward a reaction container, or the like, and cause a reaction to produce a chemical drug.

The printer 1 may be provided with a position sensor, a velocity sensor, a temperature sensor, or the like, so that the controller 88 controls each module of the printer 1 in accordance with the state of each module of the printer 1 determined based on the information from each sensor. For example, if the discharge property of the discharged liquid, i.e., the discharge amount or the discharge velocity, is affected by the temperature of the liquid discharge head 2, the temperature of the liquid in the liquid supply tank, which supplies the liquid to the liquid discharge head 2, the pressure applied to the liquid discharge head 2 by the liquid in the liquid supply tank, etc, the drive signal for discharging the liquid may be changed in accordance with the information.

Figure 2A:
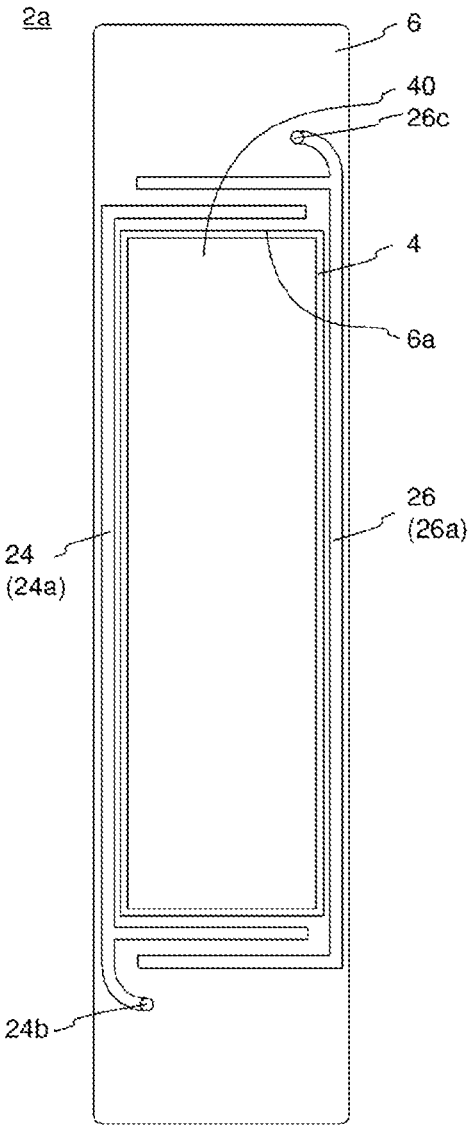
FIG. 2A is a plan view of a head main body that is the relevant part of the liquid discharge head in FIGS. 1A and 1B.
Figure 2B:
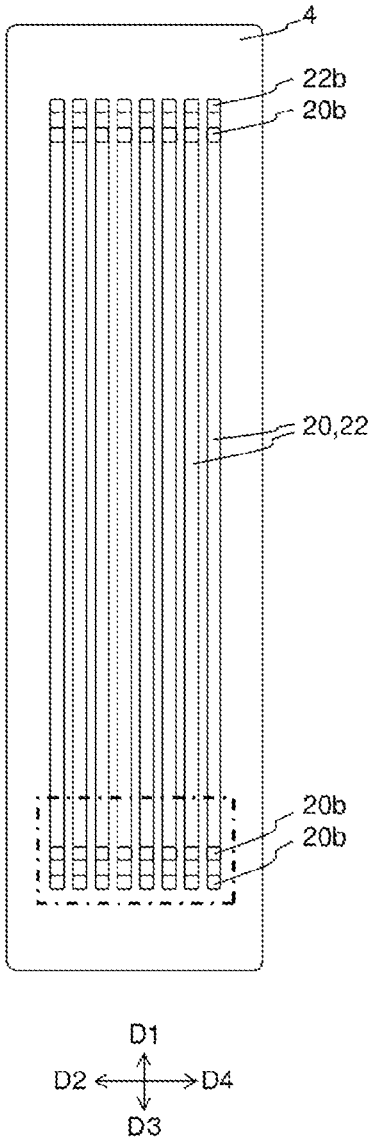
FIG. 2B is a plan view in which a second flow path member is removed from FIG. 2A.
Figure 3:
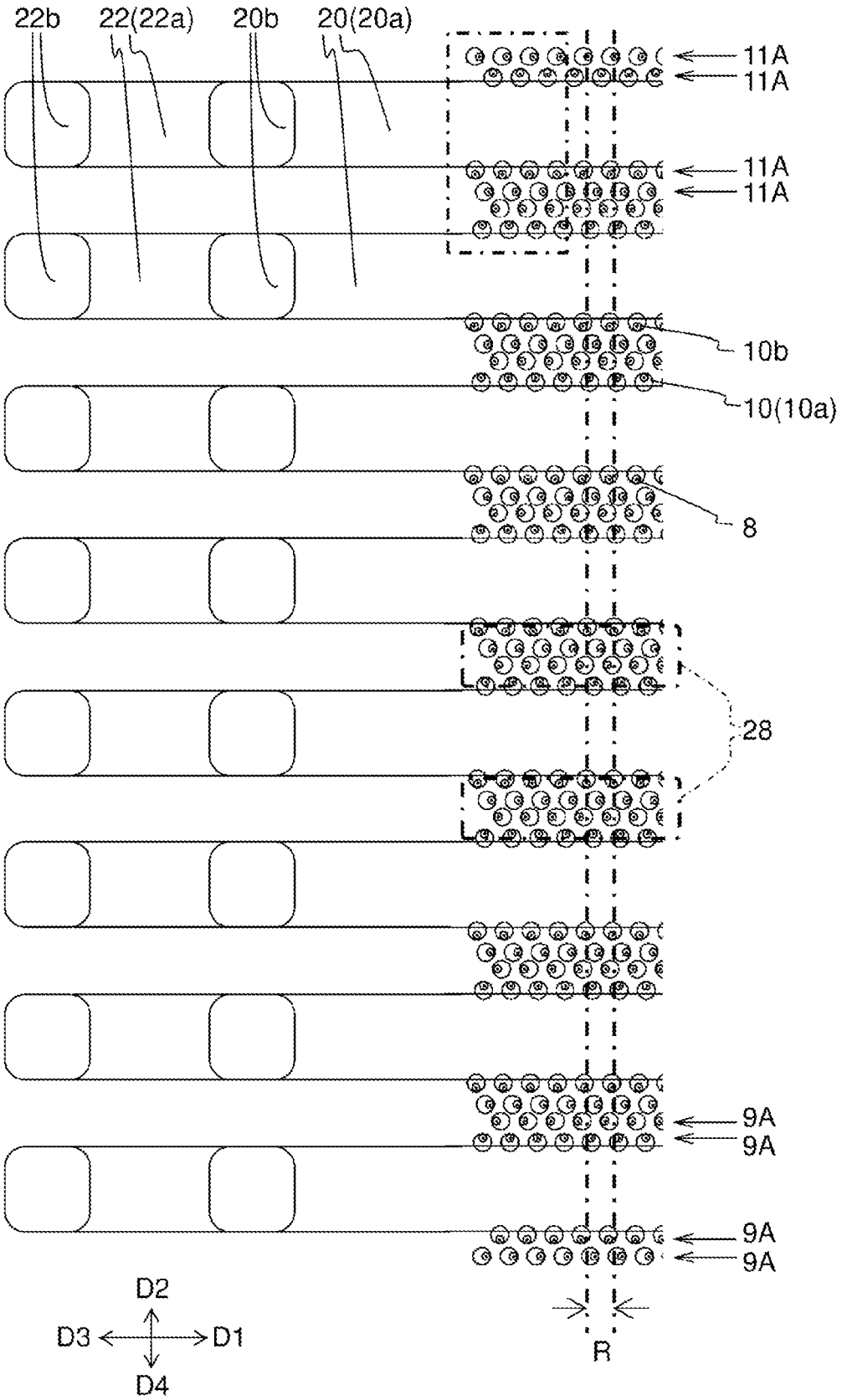
FIG. 3 is an enlarged plan view of the part of FIG. 2B.
Figure 4:
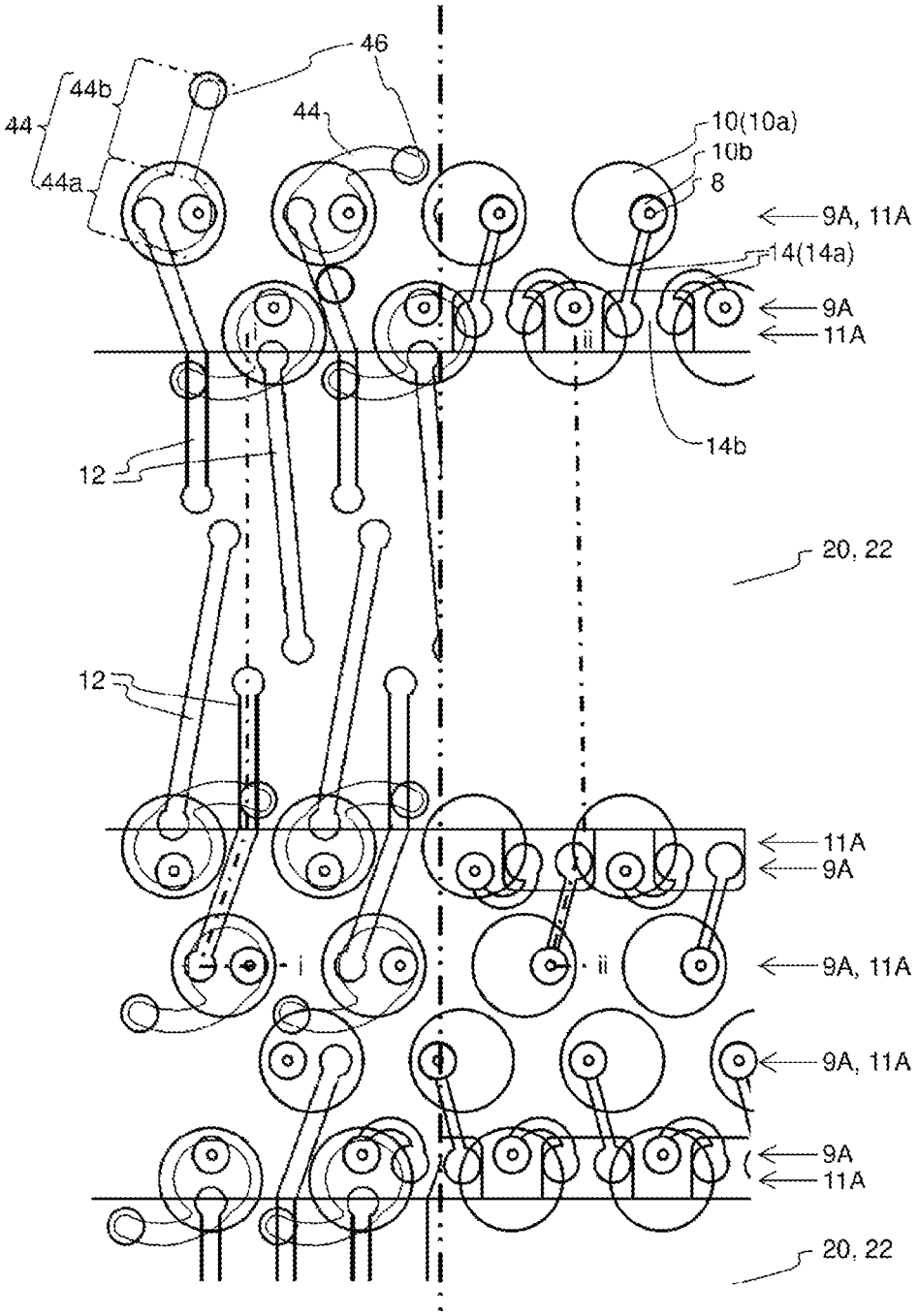
FIG. 4 is an enlarged plan view of the part of FIG. 2B.
Figure 5A:
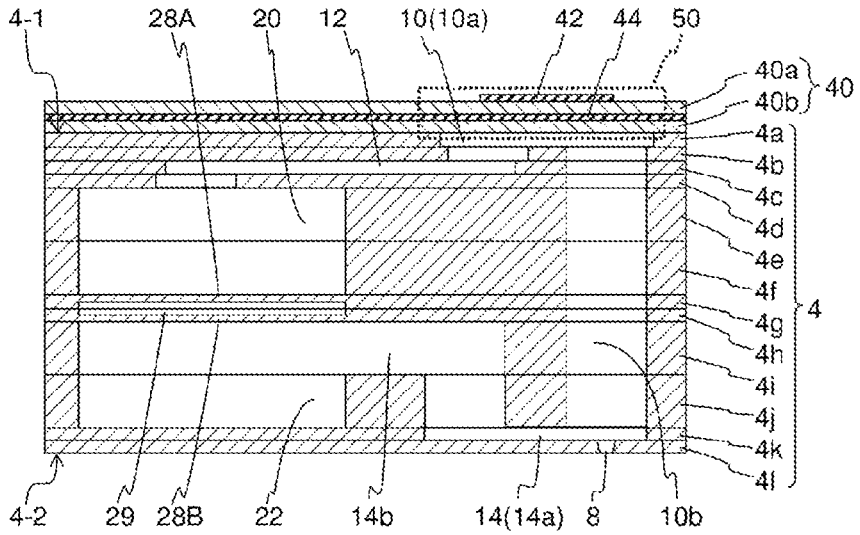
FIG. 5A is a schematic partial longitudinal sectional view of the head main body.
Figure 5B:
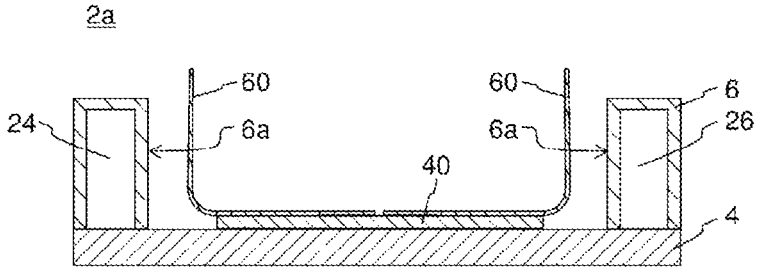
FIG. 5B is a longitudinal sectional view of other parts of the head main body.

Then, the liquid discharge head 2 according to embodiments of the present disclosure is described. FIG. 2A is a plan view that illustrates a head main body 2*a* that is the relevant part of the liquid discharge head 2 illustrated in FIGS. 1A and 1B. FIG. 2B is a plan view of the state where a second flow path member 6 is removed from the head main body 2*a*. FIG. 3 is an enlarged plan view of the head main body 2*a* in the range of the dashed-dotted line of FIG. 2B. FIG. 4 is an enlarged plan view of the head main body 2*a* in the range of the dashed-dotted line of FIG. 3. FIG. 5A is a schematic partial longitudinal sectional view of the head main body 2*a*. To represent the state where flow paths are connected, FIG. 5A illustrates the flow paths that do not exist on the same vertical cross-section in actuality as if they exist on the same vertical cross-section. Specifically, the portion above a plate 4*g* is the cross-section along i-i in FIG. 4, and the portion below a plate 4*h* is the cross-section along ii-ii in FIG. 4. FIG. 5B is a longitudinal sectional view of other parts of the head main body 2*a*. FIG. 5B also illustrates a signal transmitter 60 that is not illustrated in FIG. 2A.

Each figure is illustrated as described below for easy understanding of the figure. FIGS. 2A to 4 illustrate, in a solid line, for example a flow path that is located under a different module and is supposed to be illustrated in a dashed line. A second individual flow path 14 is omitted from the illustration on the left side of the chain double-dashed line at the center for dividing the figure on the right and left in FIG. 4, and a first individual flow path 12, an individual electrode 44, and a connection electrode 46 are omitted from the illustration on the right side of the chain double-dashed line.

The liquid discharge head 2 may include a housing, a driver IC, a wiring board, or the like, in addition to the head main body 2*a*. The head main body 2*a* includes a first flow path member 4, the second flow path member 6 that supplies the liquid to the first flow path member 4, and a piezoelectric actuator board 40 including a displacement element 50. The piezoelectric actuator board 40 corresponds to a pressure applying module. The head main body 2*a* has a flat-plate shape that is elongated in a first direction, and the direction is sometimes referred to as the longitudinal direction. The second flow path member 6 serves as a support member that supports the structure of the head main body 2*a*, and the head main body 2*a* is secured to the frame 70 at both ends of the second flow path member 6 in the longitudinal direction.

The first flow path member 4 forming the head main body 2*a* has a flat-plate shape and has a thickness of approximately 0.5 to 2 mm. On a pressure-applying chamber surface 4-1, which is one of the surfaces of the first flow path member 4, a large number of pressure applying chambers 10 are arranged in a row in a planar direction. On the discharge-hole surface 4-2, which is the surface opposite to the pressure-applying chamber surface 4-1 of the first flow path member 4, a large number of the discharge holes 8 for discharging the liquid are arranged in a row in a planar direction. Each of the discharge holes 8 is connected to the pressure applying chamber 10. In the following description, the pressure-applying chamber surface 4-1 is located above the discharge-hole surface 4-2.

In the first flow path member 4, a plurality of first common flow paths 20 and a plurality of second common flow paths 22 are provided such that they extend in the first direction. Hereafter, the first common flow path 20 and the second common flow path 22 are sometimes collectively referred to as a common flow path. The first common flow path 20 and the second common flow path 22 are provided such that they are overlapped in a vertical direction. The direction perpendicular to the first direction is a second direction. In the example illustrated in FIGS. 2A to 3, there are the eight first common flow paths 20 and the eight second common flow paths 22, and they are arranged in a row in the second direction. The direction opposite to the first direction is a third direction, the direction opposite to the second direction is a fourth direction, and the direction that intersects with the first direction is a fifth direction. In each figure, the first to the fifth directions are denoted by Dl to D5.

Along both sides of the first common flow path 20 and the second common flow path 22, the pressure applying chambers connected to the first common flow path 20 and the second common flow path 22 and the discharge holes 8 connected to the pressure applying chambers 10 are arranged. The pressure applying chambers 10 connected to the first common flow path 20 and the second common flow path 22 form a pressure-applying chamber row 11A in two rows on each side of the common flow path, four rows in total on both sides. The discharge holes 8 connected to the first common flow path 20 and the second common flow path 22 form a discharge hole row 9A in two rows on each side of the common flow path, four rows in total on both sides. As there are the 8 first common flow paths 20 and the 8 second common flow paths 22, there are the 32 pressure-applying chamber rows 11A and the 32 discharge hole rows 9A in total.

The first common flow path 20 and the pressure applying chambers 10 in four rows arranged on both sides thereof are connected via the first individual flow paths 12. The second common flow path 22 and the pressure applying chambers 10 in four rows arranged on both sides thereof are connected via the second individual flow paths 14.

With the above configuration, in the first flow path member 4, the liquid supplied to the first common flow path 20 flows into the pressure applying chamber 10 arranged along the first common flow path 20 so that part of the liquid is discharged through the discharge hole 8 due to the pressure applied by the piezoelectric actuator board 40 and the other part of the liquid flows into the second common flow path 22 that is overlapped with the first common flow path 20 and is discharged to the outside from the first flow path member 4.

The first common flow path 20 is located above the second common flow path 22 in an overlapped manner. The first common flow path 20 is opened to the outside of the first flow path member 4 through openings 20*b* provided on both ends in the first direction and the third direction outside the range where the first individual flow path 12 is connected. The second common flow path 22 is opened to the outside of the first flow path member 4 through openings 22*b* provided on both ends in the first direction and the third direction outside the range where the second individual flow path 14 is connected and on the outer side of the openings 20*b* of the first common flow path 20. As the opening 22*b* of the second common flow path 22 located on the lower side is provided on the outer side of the opening 20*b* of the first common flow path 20 located on the upper side, the space efficiency is improved.

Substantially the same amount of liquid is supplied through the opening 20*b* of the first common flow path 20 on the first direction side and the opening 20*b* on the third direction side, and it flows toward the center of the first common flow path 20. If the amount of liquid discharged through the discharge hole 8 connected to one of the first common flow paths 20 and one of the second common flow paths 22 is substantially constant regardless of the location, the flow in the first common flow path 20 becomes slower as it is closer to the center and becomes zero at substantially the center. Conversely, the flow in the second common flow path 22 is zero at substantially the center and becomes faster as it is closer to the outer side.

As the liquid discharge head 2 executes various types of recording, the amount of liquid discharged through the discharge holes 8 connected to one of the first common flow paths 20 and one of the second common flow paths 22 has various distributions. If the discharge amount through the discharge hole 8 on the first direction side is large, the position where the flow is zero is on the first direction side with respect to the center. Conversely, if the discharge amount through the discharge hole 8 on the third direction side is large, the position where the flow is zero is on the third direction side with respect to the center. Thus, changes in the discharge distribution depending on recording causes a movement of the position where the flow is zero. Thus, even if the flow becomes zero at a certain moment and the liquid remains, the remaining flow at the position is eliminated due to a change in the discharge distribution; therefore, it is possible to prevent sinking of a pigment, adhering of a liquid, or the like, due to the liquid remaining at the same position.

The pressure applied to the part of the first individual flow path 12, which is connected to the first common flow path 20, on the side of the first common flow path 20 is changed in accordance with the connecting position (principally, the position in the first direction) of the first individual flow path 12 with the first common flow path 20 due to the effect of a pressure loss. The pressure applied to the part of the second individual flow path 14, which is connected to the second common flow path 22, on the side of the first common flow path 22, is changed in accordance with the connecting position (principally, the position in the first direction) of the second individual flow path 14 with the second common flow path 22 due to the effect of a pressure loss. If the pressure of the liquid in one of the discharge holes 8 becomes substantially zero, the above-described pressure changes symmetrically so that the pressures of the liquids in all the discharge holes 8 may become substantially zero.

In one of the discharge hole rows 9A, the discharge holes 8 are disposed at the interval of 50 dpi (approximately 25.4 mm/50). As there are the 32 discharge hole rows 9A and the discharge holes 8 included therein are arranged at different positions from each other in the first direction, the discharge holes 8 are disposed at the interval of 1600 dpi in whole.

More specifically, in FIG. 3, when the discharge holes 8 are projected in the direction perpendicular to the first direction, the 32 discharge holes 8 are projected within the range of a virtual straight line R, and the discharge holes are disposed at the interval of 1600 dpi within the virtual straight line R. Thus, when the print sheet P is conveyed for printing in the direction perpendicular to the virtual straight line R, the printing may be executed with a resolution of 1600 dpi.

The second flow path member 6 is joined to the pressure-applying chamber surface 4-1 of the first flow path member 4, and it includes: a first combining flow path 24 for supplying the liquid to the first common flow path 20; and a second combining flow path 26 for collecting the liquid from the second common flow path 22. The thickness of the second flow path member 6 is approximately 5 to 30 mm, which is thicker than that of the first flow path member 4.

The second flow path member 6 is joined to the area of the pressure-applying chamber surface 4-1 of the first flow path member 4 where the piezoelectric actuator board 40 is not coupled. More specifically, it is joined so as to surround the piezoelectric actuator board 40. Thus, it is possible to prevent part of the discharged liquid from adhering as mist to the piezoelectric actuator board 40. As the outer periphery of the first flow path member 4 is fixed such that the piezoelectric actuator board 40 is surrounded, it is possible to prevent the occurrence of resonance, etc. due to the vibration of the first flow path member 4 together with the driving of the displacement element 50.

An opening 24*b* is provided on the end of the first combining flow path 24 in the third direction and is formed on the upper surface of the second flow path member 6. The first combining flow path 24 is bifurcated into two portions; one of them connects to the opening 20*b* of the first common flow path on the third-direction side, and the other one of them connects to the opening 20*b* of the first common flow path 20 on the first-direction side. An opening 26*b* is provided on the end of the second combining flow path 26 in the first direction and is formed on the upper surface of the second flow path member 6. The second combining flow path 26 is bifurcated into two portions; one of them connects to the opening 22*b* of the second common flow path 22 on the first-direction side, and the other one of them connects to the opening 22*b* of the second common flow path 22 on the third-direction side. In the case of printing, the liquid is supplied from outside through the opening 24*b* of the first combining flow path 24, and the undischarged liquid is collected through the opening 26*b* of the second combining flow path 26.

The second flow path member 6 is provided with a through-hole 6*a* that penetrates the second flow path member 6 in a vertical direction. The signal transmitter 60, such as an FPC (Flexible Printed Circuit) that transmits a drive signal for driving the piezoelectric actuator board 40, is inserted through the through-hole 6*a*.

As the first combining flow path 24 is provided in the second flow path member 6 that is different from the first flow path member 4 and is thicker than the first flow path member 4, the cross-sectional area of the first combining flow path 24 may be increased, and accordingly a difference in the pressure loss due to a difference in the connecting positions of the first combining flow path 24 and the first common flow path 20 may be reduced. The flow path resistance of the first combining flow path 24 is preferably equal to or less than 1/100 of the first common flow path 20. More precisely, the flow path resistance of the first combining flow path 24 is the flow path resistance in the range where the first combining flow path 24 is coupled to the first common flow path 20.

As the second combining flow path 26 is provided in the second flow path member 6 that is different from the first flow path member 4 and is thicker than the first flow path member 4, the cross-sectional area of the second combining flow path 26 may be increased, and accordingly a difference in the pressure loss due to a difference in the connecting positions of the second combining flow path 26 and the second common flow path 22 may be reduced. The flow path resistance of the second combining flow path 26 is preferably equal to or less than 1/100 of the second common flow path 22. More precisely, the flow path resistance of the second combining flow path 26 is the flow path resistance in the range where the second combining flow path 26 is coupled to the first combining flow path 24.

A configuration is such that the first combining flow path 24 is provided on the end of the second flow path member 6 in the second direction, the second combining flow path 26 is provided on the end of the second flow path member 6 in the fourth direction, and the respective flow paths are opposed to the first flow path member 4 so as to be coupled to the first common flow path 20 and the second common flow path 22, respectively. This configuration may increase the cross-sectional areas of the first combining flow path 24 and the second combining flow path 26 and reduce the flow path resistance. With this configuration, as the outer periphery of the first flow path member 4 is fixed by the second flow path member 6, the rigidity may be improved.

The lower surface of the second flow path member 6 is provided with the groove forming the first combining flow path and the groove forming the second combining flow path 26. Part of the lower surface of the groove of the second flow path member 6 for forming the first combining flow path 24 is closed by the upper surface of the first flow path member 4 and the other part of the lower surface is connected to the opening 20*b* of the first common flow path 20 provided on the upper surface of the first flow path member 4, whereby the first combining flow path 24 is formed. Part of the lower surface of the groove of the second flow path member 6 for forming the second combining flow path 26 is closed by the upper surface of the first flow path member 4, and the other part of the lower surface is connected to the opening 22*b* of the second common flow path 22 provided on the upper surface of the first flow path member 4, whereby the second combining flow path 26 is formed.

The first combining flow path 24 and the second combining flow path 26 may be provided with a damper to stabilize the supplied or discharged liquid in accordance with a change in the amount of discharged liquid. A filter may be provided inside the first combining flow path 24 and the second combining flow path 26 and/or between the first common flow path 20 and the second common flow path 22 to prevent foreign matter or air bubbles from entering the first flow path member 4.

The upper surface of the second flow path member 6 is covered with a metallic housing, etc. The signal transmitter 60 is electrically connected to a wiring board housed in for example a housing. The wiring board and the controller 88 are electrically connected via a cable, etc. A driver IC for driving the displacement element 50 may be installed in the signal transmitter 60. The driver IC is in contact with a metallic housing or a member that easily transmits heat to the housing, whereby it is possible to release the heat generated by the driver IC to the outside.

The piezoelectric actuator board 40 including the displacement elements 50 is joined to the pressure-applying chamber surface 4-1 and is provided such that each of the displacement elements 50 is located above the pressure applying chamber 10. The piezoelectric actuator board 40 occupies the area having substantially the same shape as that of a pressure applying chamber group including the pressure applying chambers 10. An opening of each of the pressure applying chambers 10 is closed by the piezoelectric actuator board 40 joined to the pressure-applying chamber surface 4-1 of the first flow path member 4. The piezoelectric actuator board 40 has a rectangular shape that is elongated in the same direction as that of the head main body 2*a*. The piezoelectric actuator board 40 is coupled to the signal transmitter 60 that feeds a signal to each of the displacement elements 50. The second flow path member 6 includes the vertically penetrating through-hole 6*a* at the center so that the signal transmitter 60 is electrically connected to the controller 88 through the through-hole 6*a*. The signal transmitter 60 is shaped to extend in a lateral direction from the end on one of the long sides of the piezoelectric actuator board 40 to the end on the other one of the long sides, and the wires provided on the signal transmitter 60 extend in the lateral direction and are lined up in the longitudinal direction; thus, it is possible to increase the distance between the wires.

The individual electrode 44 is provided at the position opposed to each of the pressure applying chambers 10 on the upper surface of the piezoelectric actuator board 40.

The first flow path member 4 has a laminate structure in which a plurality of plates is laminated. A plate 4*a* is provided at the side of the pressure-applying chamber surface 4-1 of the first flow path member 4 and, under the plate 4*a*, plates 4*b* to 4*l* are sequentially laminated. In some cases, the plate 4*a* having a hole formed as the side wall of the pressure applying chamber 10 is referred to as a cavity plate 4*a*, the plates 4*e*, 4*f*, 4*i*, 4*j* having a hole formed as the side wall of the common flow path are referred to as the manifold plates 4*e*, 4*f*, 4*i*, 4*j*, and the plate 4*l* having the discharge hole 8 is referred to as the nozzle plate 4*l*. A large number of holes and grooves are provided in each plate. The holes and the grooves may be formed by, for example, etching each plate made of a metal. As each plate has a thickness of approximately 10 to 300 μm, a hole may be formed with a high forming accuracy. The plates are laminated in the adjusted positions so that the holes communicate with each other to form a flow path such as the first common flow path 20.

The pressure-applying chamber surface 4-1 of the flat-plate first flow path member 4 has an opening of a pressure-applying chamber main body 10*a* and is joined to the piezoelectric actuator board 40. The pressure-applying chamber surface 4-1 includes the opening 20*b* for supplying the liquid to the first common flow path 20 and the opening 22*b* for collecting the liquid from the second common flow path 22. The discharge-hole surface 4-2 of the first flow path member 4 on the opposite side of the pressure-applying chamber surface 4-1 has the discharge hole 8.

The structure for discharging the liquid includes the pressure applying chamber 10 and the discharge hole 8. The pressure applying chamber 10 includes: the pressure-applying chamber main body 10*a* opposed to the displacement element 50; and a partial flow path 10*b* having a cross-sectional area smaller than that of the pressure-applying chamber main body 10*a*. The pressure-applying chamber main body 10*a* is formed in the cavity plate 4*a*, the partial flow path 10*b* is formed by overlapping the holes formed in the plates 4*b* to 4*k*, and the part other than the discharge hole 8 is closed by the nozzle plate 4*l*.

The pressure-applying chamber main body 10*a* is connected to the first individual flow path 12, and the first individual flow path 12 is connected to the first common flow path 20. The first individual flow path 12 includes a circular hole penetrating the plate 4*b*; an elongated penetrating groove extending in the plate 4*c* in a planar direction; and a circular hole penetrating the plate 4*d*.

The partial flow path 10*b* is connected to the second individual flow path 14, and the second individual flow path 14 is connected to the second common flow path 22. The second individual flow path 14 includes: a first portion 14*a* including an elongated penetrating groove connected to the circular hole forming the partial flow path 10*b* in the plate 4*k* and extending in a planar direction and a circular hole penetrating the plate 4*j*; and a second portion 14*b* that is a rectangular hole penetrating the plate 4*i* and connected to the penetrating groove forming the second common flow path 22. The second portion 14*b* is shared by the second individual flow path 14 connected to the different partial flow path 10*b*, and the first portions 14*a* of the two second individual flow paths 14 are combined together at the second portion 14*b* of the plate 4*i* and then connected to the second common flow path 22.

The first common flow path 20 is formed by overlapping the holes formed in the plates 4*e*, 4*f*, and the upper side thereof is closed by the plate 4*d* and the lower side thereof by the plate 4*g*. The second common flow path 22 is formed by overlapping the holes formed in the plates 4*i*, 4*j*, and the upper side thereof is closed by the plate 4*h* and the lower side thereof by the plate 4*k*.

The flow of the liquid is summarized; the liquid supplied to the first combining flow path 24 sequentially passes through the first common flow path 20 and the first individual flow path 12 to enter the pressure applying chamber 10, and part of the liquid is discharged through the discharge hole 8. The undischarged liquid enters the second common flow path 22 through the second individual flow path 14, then enters the second combining flow path 26, and is discharged out of the head main body 2*a*.

The piezoelectric actuator board 40 has a laminate structure including two piezoceramic layers 40*a*, 40*b* that are piezoelectric body. Each of the piezoceramic layers 40*a*, 40*b* has a thickness of approximately 20 μm. That is, the thickness of the piezoelectric actuator board 40 from the upper surface of the piezoceramic layer 40*a* to the lower surface of the piezoceramic layer 40*b* is approximately 40 μm. The ratio of the piezoceramic layer 40*a* to the piezoceramic layer 40*b* in thickness is 3:7 to 7:3, preferably 4:6 to 6:4. Each of the piezoceramic layers 40*a*, 40*b* extends such that it crosses the multiple pressure applying chambers 10. The piezoceramic layers 40*a*, 40*b* are made of, for example, a ceramic material having ferroelectricity, such as lead zirconate titanate (PZT) series, $NaNbO_3$ series, $BaTiO_3$ series, (BiNa)$NbO_3$ series, or $BiNaNb_5O_{15}$ series. The piezoceramic layer 40*b* serves as a vibration plate according to embodiments and has no direct piezoelectric change. As the vibration plate, for example, metallic plates or ceramics having no piezoelectricity may be used instead of the piezoceramic layer 40*b*.

The piezoelectric actuator board 40 includes a common electrode 42 that is made of a metallic material such as Ag—Pd series and the individual electrode 44 that is made of a metallic material such as Au series. The common electrode 42 has a thickness of approximately 2 μm, and the individual electrode 44 has a thickness of approximately 1 μm.

Each of the individual electrodes 44 is provided on the upper surface of the piezoelectric actuator board 40 at the position opposed to each of the pressure applying chambers 10. The individual electrode 44 includes an individual-electrode main body 44*a* that is slightly smaller than the pressure-applying chamber main body 10*a* in a planar shape and has substantially the similar shape to that of the pressure-applying chamber main body 10*a*; and an extraction electrode 44*b* that is extracted from the individual-electrode main body 44*a*. The connection electrode 46 is provided at the extracted part at the end of the extraction electrode 44*b* and outside the area opposed to the pressure applying chamber 10. The connection electrode is formed of a conductive resin including conductive particles such as silver particles with a thickness of approximately 5 to 200 μm. The connection electrode 46 is electrically connected to an electrode provided in the signal transmitter 60.

As described later in detail, the controller 88 feeds a drive signal to the individual electrode 44 via the signal transmitter 60. A drive signal is supplied at a certain cycle in synchronization with the conveying speed of the print sheet P.

The common electrode 42 is formed in the area between the piezoceramic layer 40*a* and the piezoceramic layer 40*b* substantially entirely in a planar direction. That is, the common electrode 42 extends so as to cover all the pressure applying chambers 10 in the area opposed to the piezoelectric actuator board 40. The common electrode 42 is connected to a common-electrode surface electrode (not illustrated) formed on the piezoceramic layer 40*a* at the position away from the electrode group including the individual electrodes 44 via a penetrating conductor that is formed to penetrate through the piezoceramic layer 40*a*. The common electrode 42 is grounded via the common-electrode surface electrode so as to be held at the ground potential. In the same manner as the individual electrode 44, the common-electrode surface electrode is directly or indirectly connected to the controller 88.

The part of the piezoceramic layer 40*a* sandwiched between the individual electrode 44 and the common electrode 42 is the displacement element 50 having a unimorph structure that is polarized in a thickness direction and is displaced when a voltage is applied to the individual electrode 44. More specifically, when an electric field is applied to the piezoceramic layer 40*a* in the direction of polarization while the individual electrode 44 and the common electrode 42 have different potentials, the area to which the electric field is applied serves as an active site that is distorted due to the piezoelectric effect. With this configuration, when the controller 88 causes the individual electrode 44 to have a predetermined positive or negative potential with respect to the common electrode 42 such that the electric field and the polarization have the same direction, the part (active site) of the piezoceramic layer 40*a* sandwiched between the electrodes contracts in a planar direction. Conversely, as the piezoceramic layer 40*b*, which is an inactive layer, is not affected by the electric field, it does not contract spontaneously but restricts a deformation of an active site. As a result, there is a difference between the piezoceramic layer 40*a* and the piezoceramic layer 40*b* in the distortion in the direction of polarization, and the piezoceramic layer 40*b* is deformed (unimorph deformation) to protrude toward the pressure applying chamber 10.

Then, the operation to discharge the liquid is described. The displacement element 50 is driven (displaced) based on a drive signal fed to the individual electrode 44 via a driver IC, or the like, under the control of the controller 88. According to embodiments, although the liquid may be discharged based on various drive signals, what is called a pull-push driving method is described here.

A high electric potential (hereinafter referred to as a high potential) is previously set to the individual electrode 44 as compared with the common electrode 42, the same electric potential (hereinafter referred to as a low potential) as that of the common electrode 42 is temporarily set to the individual electrode 44 each time a discharge request is received, and then a high potential is set again at a predetermined timing. Thus, when the individual electrode 44 has a low potential, the piezoceramic layers 40*a*, 40*b* (start to) return to the original (flat) shape, whereby the volume of the pressure applying chamber 10 increases as compared with that in the initial state (the state where the two electrodes have different electric potentials). Thus, a negative pressure is applied to the liquid in the pressure applying chamber 10.

Accordingly, the liquid in the pressure applying chamber 10 starts to vibrate in a natural vibration period. Specifically, the volume of the pressure applying chamber 10 first starts to increase, and the negative pressure gradually decreases. Then, the volume of the pressure applying chamber 10 reaches its maximum, and the pressure becomes substantially zero. Then, the volume of the pressure applying chamber 10 starts to decrease, and the pressure increases. Afterward, when the pressure reaches substantially the maximum, the individual electrode 44 is set to have a high potential. Accordingly, the combination of the initially applied vibration and the subsequently applied vibration causes a higher pressure applied to the liquid. This pressure propagates through the partial flow path 10*b* to cause the liquid to be discharged through the discharge hole 8.

That is, liquid drops may be discharged by supplying, to the individual electrode 44, a drive pulse signal having a high potential as a reference and a low potential in a certain time period. If the pulse width has an AL (Acoustic Length) that is half the natural vibration period of the liquid in the pressure applying chamber 10, the discharge velocity and the discharge amount of the liquid may be maximized in principle. Although the natural vibration period of the liquid in the pressure applying chamber 10 is largely affected by the physical property of the liquid or the shape of the pressure applying chamber 10, it is also affected by the physical property of the piezoelectric actuator board 40 or the property of a flow path connected to the pressure applying chamber 10.

Figure 6:
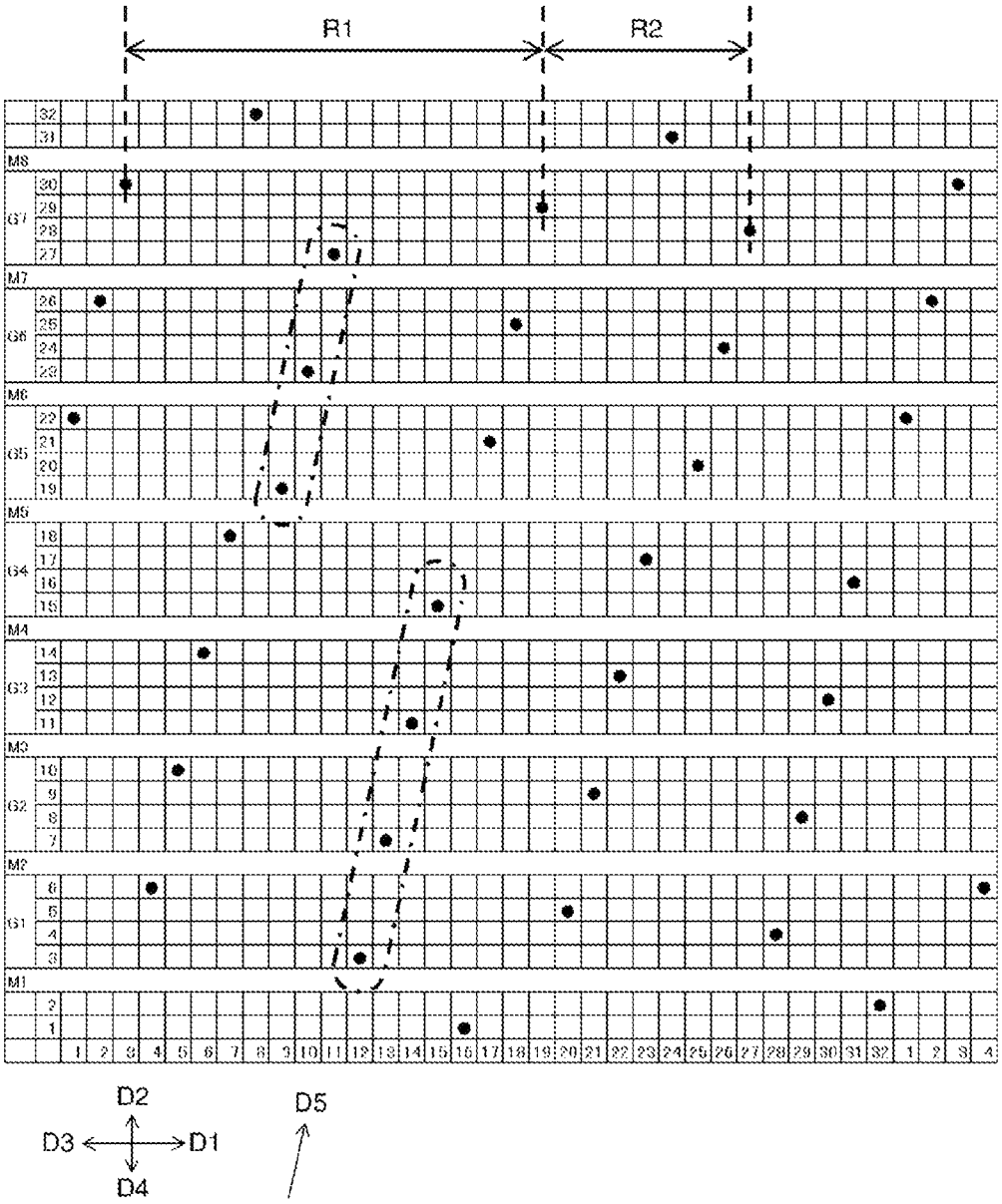
FIG. 6 is an example of the arrangement of discharge holes according to the present disclosure.

Then, the arrangement of the discharge holes 8 is described. FIG. 6 is an example of the discharge hole arrangement that may be used in the above-described liquid discharge head 2. Although the above-described liquid discharge head 2 is a circulating head that collects an undischarged liquid, this discharge hole arrangement may be used for a non-circulating head that does not execute collection.

In the circulating head, one or both of the first common flow path 20 and the second common flow path 22 may satisfy the relationship between the common flow path and the discharge hole 8 as described below. When the first common flow path 20 and the second common flow path 22 are arranged in an overlapped manner and the relationship between the common flow path and the discharge hole 8 described below is satisfied, the visual effects of printing may be improved, and the spatial use efficiency may be increased. In a non-circulating head, for example, it is possible that the second common flow path 22 of the above-described liquid discharge head 2 is omitted, the first common flow path 20 has a deeper depth, and the liquid is supplied from the first common flow path 20 to the pressure applying chamber 10. In such a head, it is appropriate if the first common flow path 20 satisfies the relationship between the common flow path and the discharge hole 8 as described below.

In FIG. 6, a black circle represents the discharge hole 8. One cell in a horizontal direction, which is the first direction, in FIG. 6 corresponds to the resolution of the liquid discharge head 2, and it is $1/1600$ inches (one sixteen-hundredth of one inch). The discharge holes 8 form the discharge hole row 9A in which the discharge holes 8 are provided in the first direction at an interval of $32/1600$ inches. The discharge holes 8 are repeatedly provided at an interval of $32/1600$ inches in the same pattern, and the pattern continues on the right side and the left side of FIG. 6.

In FIG. 6, there are eight common flow paths (M1 to M8). For the general description, the number of common flow paths is n. The common flow paths are referred to as a first-line common flow path, a second-line common flow path, . . . , and an n-th line common flow path in the order of the arrangement in the second direction. In FIG. 6, the first-line common flow path is denoted by M1 and the second-line common flow path by M2.

One common flow path is connected to the four discharge hole rows 9A. The four discharge hole rows 9A connected to the common flow path are referred to as a first discharge hole row, a second discharge hole row, a third discharge hole row, and a fourth discharge hole row in order of the arrangement in the second direction. The discharge hole 8 belonging to the first discharge hole row is referred to as a first-row discharge hole.

According to embodiments, the discharge hole rows 9A connected to an f-th line common flow path (f is every one of 1, 2, . . . , and n) are referred to as a 4×f−3-th discharge hole row, a 4×f−2-th discharge hole row, a 4×f−1-th discharge hole row, and a 4×f-th discharge hole row in order of the arrangement in the second direction, and the discharge holes 8 belonging to the discharge hole row 9A are referred to as a 4×f−3-th row discharge hole, an 4×f−2-th row discharge hole, an 4×f−1-th row discharge hole, and an 4×f-th row discharge hole.

In FIG. 6, the numbers of columns are assigned in the first direction, sequentially starting from the $22^{nd}$-row discharge hole. As described above, as the rows and the columns are defined, the $22^{nd}$-row discharge hole is located on the first column, and the discharge hole 8 is represented as the discharge hole (22,1).

The four discharge hole rows 9A provided between the first-line common flow path and the second-line common flow path, i.e., the third discharge hole row, the fourth discharge hole row, the fifth discharge hole row, and the sixth discharge hole row are collectively referred to as a first discharge hole group, and the discharge holes 8 belonging to the first discharge hole group are referred to as a first-group discharge hole. In FIG. 6, the first to seventh discharge hole groups are denoted by G1 to G7.

According to embodiments, the four discharge hole rows 9A provided between the g-th line common flow path (g is every one of 1, 2, . . . , n−1) and the g+1-th line common flow path are collectively referred to as a g-th discharge hole group, and the discharge holes 8 belonging to the g-th discharge hole group are referred to as g-group discharge holes.

The discharge property of the liquid (the amount, the velocity, the direction, and the like, of the liquid) discharged through the discharge hole 8 changes due to various factors. Fineness (high printing accuracy) through human's eyes is not simply determined depending on whether or not the discharge property of individual liquid drops is desired. In terms of an uneven density of printing, an uneven density is easily recognized if there are uneven densities at an interval of approximately 1 mm when a printed material is viewed in a close distance. When the interval of changes in the density is shorter, it is more difficult to distinguish between a dark area and a light area, and it is hard to recognize an uneven density. When the interval of changes in the density is longer, changes in the density are more gradual, and it is hard to recognize an uneven density.

In the arrangement pattern of the discharge holes 8 that are repeated at an interval of 32 columns in 1600 dpi, the arrangement pattern is repeated at an interval of $32/1600$ inches≈$25.4\times32/1600$ mm≈0.51 mm. In the arrangement pattern of the discharge holes 8 that are repeated at an interval of 32 columns in 1200 dpi, the arrangement pattern is repeated at an interval of $32/1200$ inches≈$25.4\times32/1200$ mm≈0.68 mm. These numerical values are close to 1 mm and, if there is an uneven density due to the arrangement pattern of the discharge holes 8, it is easily recognized by persons. According to the present disclosure, the interval of uneven densities that may be caused due to a specific factor is decreased so that the uneven densities are difficult to be recognized by persons.

The area between the common flow path and the different common flow path is referred to as a carry area 28 (see FIG. 3). As the first flow path member 4 is shaped like a thin plate, it oscillates due to the driving of a large number of the displacement elements 50. At that time, as each of the carry areas 28 is partitioned by the common flow path, each of them independently oscillates to some extent. The oscillation occurring in one of the carry areas 28 may affect the pressure applying chamber 10 provided in the carry area 28 and give a similar change to the discharge property of liquid droplets through the discharge hole 8 connected to the pressure applying chamber 10. For example, if the amount of liquid discharged through the discharge hole 8 is increased and further the dropping positions of the liquids are close to each other in the arrangement pattern of the discharge holes 8, the printing density becomes higher and noticeability is increased.

Even if the amount of discharged liquids is also increased, an uneven density is not noticeable when they are dispersedly located in the arrangement pattern of the discharge holes 8. In the case of dropping in a concentrated manner, the interval of uneven densities is $^{32}/_{1600}$ inches≈0.51 mm, $^{32}/_{1200}$ inches≈0.68 mm as described above, while in the case of dispersion, as there are four dark areas, 32/4/1600 inches≈0.13 mm, 32/4/1200 inches≈0.17 mm, which is the interval far from 1 mm that causes noticeability.

The discharge holes 8 connected to the same common flow path are likely to have the discharge property having the similar trend due to the vibration of the liquid in the common flow path.

From the above-described perspective, with regard to the four discharge hole rows 9A present in one of the carry areas 28, the discharge holes 8 connected to the same common flow path are located away from each other in the first direction as much as possible and the discharge holes 8 in the four discharge hole rows 9A are located relatively equally in the first direction, which may make an uneven density unnoticeable.

In the liquid discharge head 2, the adjacent discharge hole groups G3, G4 have a part in which, when a discharge hole A (6,14) is positioned in the sixth row in the discharge hole group G3, a discharge hole B (7,18) is positioned in the seventh row, which is n±1, in the adjacent discharge hole group G4 with the common flow path M4 interposed therebetween.

More specifically, first of all, an h-th row discharge hole (h is every one of 3, 5, 7, . . . , 4×n−3) and an h+1-th row discharge hole, which is located closest to the h-th row discharge hole, are located with 2×n−1 discharge holes interposed therebetween in the first direction. This means, for example in FIG. 6, the discharge holes 8 of 2×n−1=2×8−1=15 are provided in a range R1 between the discharge hole (29,19) and the discharge hole (30,3). As the h-th row discharge hole and the h+1-th row discharge hole are present in the same carry area and are connected to the same common flow path, they are located farthest from each other. With this arrangement, the pressure applying chambers 10 connected to them may be easily located away from each other, and the crosstalk between the pressure applying chambers 10 may be easily reduced.

Furthermore, an i-th row discharge hole (i is every one of 4, 8, 12, . . . , 4×(n−1)) and an i+1-th row discharge hole located closest to the i-th row discharge hole are located with the n−1 discharge holes interposed therebetween in the first direction. This means, for example in FIG. 6, the discharge holes 8 of n−1=8−1=7 are provided in a range R2 between the discharge hole (28,27) and the discharge hole (29,19). With this arrangement, the discharge holes 8 belonging to one of the discharge hole groups are arranged at equal intervals in the first direction. Thus, even if changes in the discharge property of liquid drops discharged through the discharge hole 8 are relatively large, they are less recognizable by persons.

Then, the arrangement of the discharge holes 8 that are not located in the carry areas 28, the first-row discharge hole, the second-row discharge hole, the 4×n−1-th row discharge hole, and the 4×n-th row discharge hole (hereinafter sometimes referred to as non-carry discharge holes) is described.

When the liquid discharge head 2 is attached to the printer 1, the angle of attachment in a planar direction may be inappropriate. The two discharge holes 8 adjacent in the first direction are located apart from each other in the second direction and therefore, when the liquid discharge head 2 is attached at a tilt in a planar direction, the dropping positions of the two discharge holes 8 are shifted due to the apart location in the second direction. In accordance with the direction in which the liquid discharge head 2 is tilted, the distance between the two discharge holes 8 becomes short so as to increase the color, or the distance between the two discharge holes 8 becomes long so as to reduce the color.

If the distance between the first-row discharge hole or the second-row discharge hole and the adjacent discharge hole 8 in the first direction is reduced in the second direction while the above-described arrangement of the discharge holes 8 in the carry area 28 is maintained, the distance between the 4×n−1-th row discharge hole or the 4×n-th row discharge hole and the adjacent discharge hole 8 in the first direction is increased in the second direction. Therefore, in order to prevent an increase in the distance between the non-carry discharge hole and the discharge hole 8, which is adjacent in the first direction, in the second direction, the non-carry discharge hole is adjacent in the first direction to the discharge holes 8 belonging to the discharge hole group located near the center in the second direction.

Specifically, while a discharge hole C (18,7) in the discharge hole group G4, which is located at the center in the second direction, is positioned in the seventh column, the non-carry discharge hole (32,8) is positioned in the eighth column that is the n±1 column.

Specifically, if n is an even number, the first-row discharge hole, the second-row discharge hole, the 4×n−1-th row discharge hole, and the 4×n-th row discharge hole are located adjacent to the discharge holes 8, an n/2-th group discharge hole and any of an n/2−1-th group discharge hole and an n/2+1-th group discharge hole, in the first direction. This means, when n=8, the $1^{st}$, $2^{nd}$, $31^{st}$, and $32^{nd}$ row discharge holes are located adjacent to the discharge holes 8, an n/2=$4^{th}$ group discharge hole and any of an n/2−1=$3^{rd}$ group discharge hole and an n/2+1=$5^{th}$ group discharge hole, in the first direction. In FIG. 6, for example, the discharge hole (32,8), which is the $32^{nd}$ row discharge hole, is located adjacent to the discharge hole (18,7) and the discharge hole (19,9) in the first direction. As the discharge hole (18,7) is the fourth group discharge hole and the discharge hole (19,9) is the fifth group discharge hole, the above-described relationship is satisfied.

Thus, the non-carry discharge hole is less affected by a deviation of the installation angle of the liquid discharge head 2.

Figure 7:
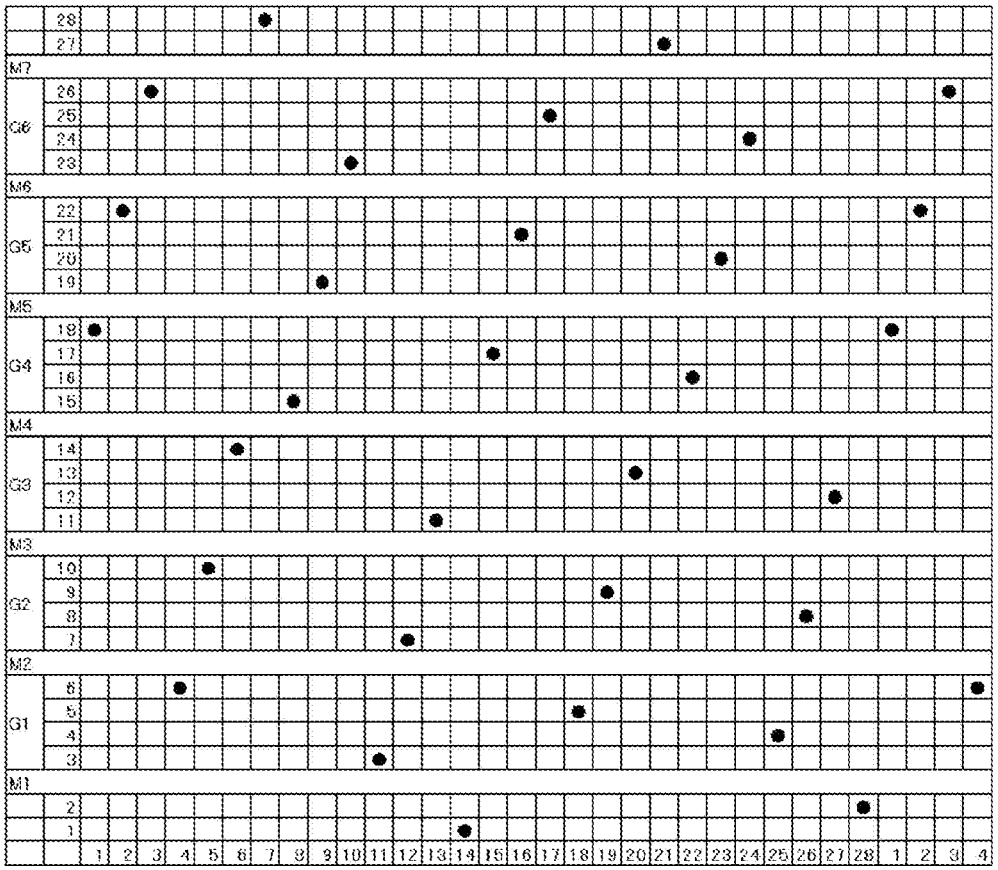
FIG. 7 is an example of the arrangement of discharge holes according to the present disclosure.

When n is an odd number, the first-row discharge hole, the second-row discharge hole, the 4×n−1-th row discharge hole, and the 4×n-th row discharge hole may be located adjacent to an (n−1)/2-th group discharge hole and an (n+1)/2-th group discharge hole. FIG. 7 is an example of the arrangement when n=7.

In the above-described arrangement, it is determined which discharge hole group the two discharge holes 8 adjacent to the non-carry discharge hole in the first direction belong to. When n is an even number, or when n is equal to or more than four, there are three discharge hole groups, and therefore two are selected from them in accordance with the above-described condition, which achieves the preferable design. When n is an odd number, or when n is equal to or more than five, there are four discharge hole groups, and therefore two are selected from them in accordance with the above-described condition, which achieves the preferable design.

The discharge hole 8 in the carry area 28 may be less affected by a deviation of the installation angle of the liquid discharge head 2 as described below.

Specifically, in a case where only the discharge holes 8 present in the carry area 28, i.e., the discharge holes 8 belonging to the discharge hole groups are viewed, when one of the discharge holes 8 located adjacent in the first direction is a j1-th group discharge hole and the other one of them is a j2-th group discharge hole (here, j1<j2), j2−j1=1 or j1=1 and j2=n−1. With reference to FIG. 6, a pair of the discharge holes 8 located adjacent in the first direction is any of the pair of the first-group discharge hole and the second group discharge hole, the pair of the second group discharge hole and the third group discharge hole, the pair of the third group discharge hole and the fourth group discharge hole, the pair of the fourth group discharge hole and the fifth group discharge hole, the pair of the fifth group discharge hole and the sixth group discharge hole, the pair of the sixth group discharge hole and the seventh group discharge hole, and the pair of the first-group discharge hole and the seventh group discharge hole, and the above-described condition is satisfied (for easy understanding, the sequence of the discharge holes 8 between the discharge hole (19,9) and the discharge hole (15,15) is surrounded by a dashed-dotted line in the illustration of FIG. 6). Although the non-carry discharge hole is provided between the fourth group discharge hole and the fifth group discharge hole in a pair, the relationship of only the discharge holes 8 provided in the carry area 28 is described here.

With this arrangement, the pair of the discharge holes 8 having the relationship of j2−j1=1 is less affected by a deviation of the installation angle of the liquid discharge head 2. Although the discharge holes 8 in a pair having the relationship of j1=1 and j2=n−1 are located relatively apart from each other in the second direction, such a pair appears four times at the equal interval in the pattern of the 32 discharge holes 8, which are not noticeable to persons.

Furthermore, k1-th row discharge holes (k1 is every one of 3, 7, 11, . . . , 4×n−5) are arranged in a row in the fifth direction, k2-th row discharge holes (k2 is every one of 4, 8, 12, . . . , 4×n−4) are arranged in a row in the fifth direction, k3-th row discharge holes (k3 is every one of 5, 9, 13, . . . , 4×n−3) are arranged in a row in the fifth direction, and k4-th row discharge holes (k4 is every one of 6, 10, 14, . . . , 4×n−2) are arranged in a row in the fifth direction.

With this arrangement, the distance in the second direction between the discharge holes 8 in a pair, which are adjacent in the fifth direction, is averaged so that the effect of a deviation of the installation angle of the liquid discharge head 2 may be reduced. Particularly, in a case where only the discharge holes 8 present in the carry area 28, i.e., the discharge holes 8 belonging to the discharge hole groups are viewed, when one of the discharge holes 8 located adjacent to each other in the first direction is a j1-th group discharge hole and the other one of them is a j2-th group discharge hole (here, j1<j2) and j2−j1=1 or j1=1 and j2=n−1, the distance between the discharge holes 8 in a pair having the relationship of j1=1 and j2=n−1 may be reduced in the second direction, and therefore it is preferable.

In FIG. 6, for example, the k4-th row discharge holes are arranged in a row between the first column and the seventh column in the fifth direction in order from the $22^{nd}$ row discharge hole, the $26^{th}$ row discharge hole, the $30^{th}$ row discharge hole, the $6^{th}$ row discharge hole, the $10^{th}$ row discharge hole, the $14^{th}$ row discharge hole, and the $18^{th}$ row discharge hole, and the above-described relationship is satisfied.

Figure 8:
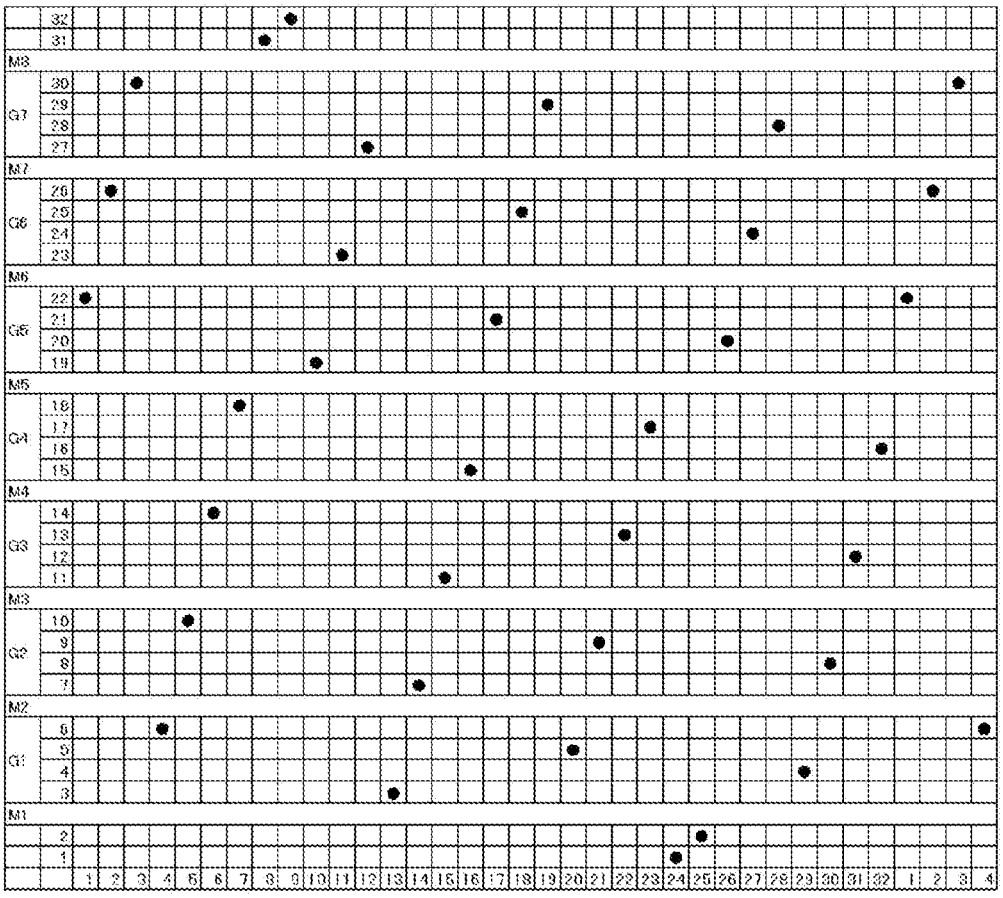
FIG. 8 is an example of the arrangement of discharge holes according to the present disclosure.
Figure 9:
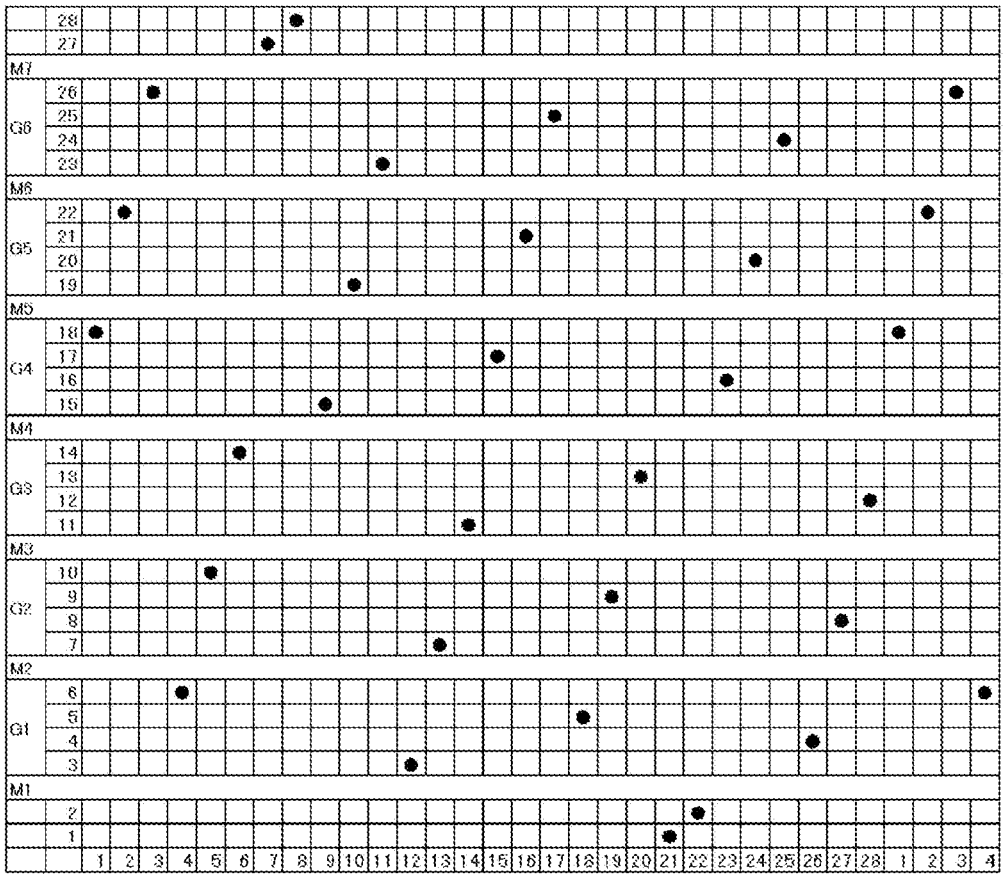
FIG. 9 is an example of the arrangement of discharge holes according to the present disclosure.

FIGS. 8 and 9 are other arrangements of the discharge holes 8 according to the present disclosure. In FIG. 8, n=8, and in FIG. 9, n=7. With regard to them, the same descriptions as those in FIG. 6 or 7 are omitted, and different points are described.

In FIGS. 8 and 9, the i-th row discharge hole (i is every one of 4, 8, 12, . . . , 4×(n−1)) and the i+1-th row discharge hole located closest to the i-th row discharge hole are located with the n−1 discharge holes interposed therebetween in the first direction. In FIGS. 8 and 9, the state is as follows. The i-th row discharge hole (i is every one of 4, 8, 12, . . . , 4×(n−1)) and the i+1-th row discharge hole located closest to the i-th row discharge hole are located with the n−2 or n discharge holes 8 interposed therebetween in the first direction.

Thus, the intervals between the discharge holes 8 present in one of the carry areas 28 in the first direction are not all the same, but the interval between the discharge holes 8 connected to a different common flow path may be shorter or longer by one column, and accordingly the design flexibility may be increased.

In FIG. 8, there are eight discharge holes between the discharge hole (28,28) that is the $28^{th}$ row discharge hole and the discharge hole (29,19) that is the $29^{th}$ row discharge hole.

In accordance with the above arrangement, the arrangement of non-carry discharge holes is as described below.

First of all, when n is an even number, the first-row discharge hole and the second-row discharge hole are located adjacent to each other in the first direction, the pair of the discharge holes 8, the first-row discharge hole and the second-row discharge hole, is located adjacent to the discharge holes 8, the n/2-th group discharge hole and any of the n/2−1-th group discharge hole and the n/2+1-th group discharge hole, the 4×n−1-th row discharge hole and the 4×n-th row discharge hole are located adjacent to each other in the first direction, and the pair of the discharge holes 8, the 4×n−1-th row discharge hole and the 4×n-th row discharge hole, is located adjacent to the discharge holes 8, the n/2-th group discharge hole and any of the n/2−1-th group discharge hole and the n/2+1-th group discharge hole.

In FIG. 8, for example, the first-row discharge hole and the second-row discharge hole, which are the discharge hole (1,24) and the discharge hole (2,25), are located adjacent to each other in the first direction, the pair of the discharge holes 8, the first-row discharge hole and the second-row discharge hole, is located adjacent to the discharge hole (17,23), which is the n/2=8/2=4$^{th}$ group discharge hole, and the discharge hole (20,26), which is the n/2+1=8/2+1=5$^{th}$ group discharge hole, the 4×n−1=4×8−1=31$^{st}$ row discharge hole and the 4×n=4×8=32$^{nd}$ row discharge hole, which are the discharge hole (31,8) and the discharge hole (32,9), are located adjacent to each other in the first direction, and the pair of the discharge holes 8, the 31$^{st}$ row discharge hole and the 32$^{nd}$ row discharge hole, is located adjacent to the discharge hole (18,7), which is the fourth group discharge hole, and the discharge hole (19,10), which is the fifth group discharge hole.

When n is an odd number, the first-row discharge hole and the second-row discharge hole are located adjacent to each other in the first direction, the pair of the discharge holes 8, the first-row discharge hole and the second-row discharge hole, is located adjacent to the (n−1)/2-th group discharge hole and the (n+1)/2-th group discharge hole, the 4×n−1-th row discharge hole and the 4×n-th row discharge hole are located adjacent to each other in the first direction, and the pair of the discharge holes 8, the 4×n−1-th row discharge hole and the 4×n-th row discharge hole, is located adjacent to the (n−1)/2-th group discharge hole and the (n+1)/2-th group discharge hole.

In FIG. 9, for example, the first-row discharge hole and the second-row discharge hole, which are the discharge hole (1,21) and the discharge hole (2,22), are located adjacent to each other in the first direction, the pair of the discharge holes 8, the first-row discharge hole and the second-row discharge hole, is located adjacent to the discharge hole (13,20), which is the (n−1)/2=(7−1)/2=3$^{rd}$ group discharge hole, and the discharge hole (16,23), which is the (n+1)/2=(7+1)/2=4th group discharge hole, the 4×n−1=4×7−1=27$^{th}$ row discharge hole and the 4×n=4×7=28$^{th}$ row discharge hole, which are the discharge hole (27,7) and the discharge hole (28,8), are located adjacent to each other in the first direction, and the pair of the discharge holes 8, the 27$^{th}$ row discharge hole and the 28$^{th}$ row discharge hole, is located adjacent to the discharge hole (14,6), which is the third group discharge hole, and the discharge hole (15,9), which is the fourth group discharge hole.

With the above-described arrangement, in the same manner as in FIGS. 6 and 7, an uneven density is less recognizable by persons, and the effect of a deviation of the installation angle of the liquid discharge head 2 may be reduced.

The discharge hole groups G1 to G7 located at the center in the second direction includes the discharge hole group G4 located at the center and the discharge hole groups G3, G5 adjacent to the discharge hole group G4 in FIGS. 6, 8. In FIGS. 7, 9, the discharge hole groups G1 to G7 located at the center in the second direction include the discharge hole groups G3, G4 located at the center.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

The invention claimed is:

1. A liquid discharge head comprising:

a plurality of discharge holes;

a plurality of pressure applying chambers that are connected to respective discharge holes of the plurality of discharge holes;

a flow path member including a plurality of common flow paths; and a plurality of pressure applying modules that apply a pressure to respective pressure applying chambers of the plurality of pressure applying chambers;

in a planar view, the plurality of common flow paths extend in a first direction, and are arranged in a row in a second direction that is perpendicular to the first direction, the plurality of discharge holes include:

a plurality of discharge hole groups arranged in a row in the second direction, and configured to be provided between adjacent common flow paths of the plurality of common flow paths; and a non-carry discharge hole that is not provided between the common flow paths, adjacent discharge hole groups of the plurality of discharge hole groups have a part in which, when a discharge hole A is positioned in an n column in one of the discharge hole groups, a discharge hole B in the discharge hole group located adjacent with the common flow path interposed therebetween is positioned in an n±1 column, and a discharge hole C in the discharge hole group located at a center in the second direction is positioned in an n column, while the non-carry discharge hole is positioned in an n±1 column.

2. The liquid discharge head according to claim 1, wherein in a planar view, the plurality of common flow paths comprises n common flow paths, where n is any one of even numbers equal to or more than four, the n common flow paths are, in order of arrangement in the second direction, a first-line common flow path, a second-line common flow path, . . . , and an n-th line common flow path, the plurality of discharge holes form a plurality of discharge hole rows arranged at a predetermined interval in the first direction, 4×n discharge hole rows of the plurality of discharge hole rows are arranged in a row in the second direction, one common flow path of the plurality of common flow paths is connected, via the plurality of pressure applying chambers, to the plurality of discharge holes belonging to the plurality of discharge hole rows, comprising two rows arranged along each side of the one common flow path, the plurality of discharge hole rows, connected to an f-th line common flow path of the plurality of common flow paths (f is every one of 1, 2, . . . , n), are, in order of arrangement in the second direction, an 4×f−3-th discharge hole row, an 4×f−2-th discharge hole row, an 4×f−1-th discharge hole row, and an 4×f-th discharge hole row, and the plurality of discharge holes belonging to the corresponding discharge hole row of the plurality of discharge hole rows are an 4×f−3-th row discharge hole, an 4×f−2-th row discharge hole, an 4×f−1-th row discharge hole, and an 4×f-th row discharge hole, four discharge hole rows of the plurality of discharge hole rows provided between the g-th line common flow path (g is every one of 1, 2, . . . , n−1) and the g+1-th line common flow path are collectively a g-th discharge hole group, and the plurality of discharge holes belonging to the g-th discharge hole group are g-group discharge holes, an h-th row discharge hole of the plurality of discharge holes (h is every one of 3, 5, 7, . . . , 4×n−3) and an h+1-th row discharge hole of the plurality of discharge holes located closest to the h-th row discharge hole are located with 2×n−1 discharge holes of the plurality of discharge holes interposed therebetween in the first direction, the i-th row discharge hole of the plurality of discharge holes (i is every one of 4, 8, 12, . . . , 4×(n−1)) and the i+1-th row discharge hole of the plurality of discharge holes located closest to the i-th row discharge hole are located with n−1 discharge holes interposed therebetween in the first direction, and a first-row discharge hole, a second-row discharge hole, a 4×n−1-th row discharge hole, and a 4×n-th row discharge hole are located adjacent to an n/2-th group discharge hole and any of an n/2−1-th group discharge hole and an n/2+1-th group discharge hole, in the first direction.

3. The liquid discharge head according to claim 2, wherein in a planar view the plurality of discharge holes includes, the k1-th row discharge holes (k1 is every one of 3, 7, 11, . . . , 4×n−5) are arranged in a k1 row in a third direction that intersects with the first direction, the k2-th row discharge holes (k2 is every one of 4, 8, 12, . . . , 4×n−4) are arranged in a k2 row in the third direction, the k3-th row discharge holes (k3 is every one of 5, 9, 13, . . . , 4×n−3) are arranged in a k3 row in the third direction, and the k4-th row discharge holes (k4 is every one of 6, 10, 14, . . . , 4×n−2) are arranged in a k4 row in the third direction.

4. The liquid discharge head according to claim 1, wherein in a planar view, the plurality of common flow paths comprises n common flow paths, where n is any one of odd numbers equal to or more than five, the n common flow paths are, in order of arrangement in the second direction, a first-line common flow path, a second-line common flow path, . . . , and an n-th line common flow path, the plurality of discharge holes form a plurality of discharge hole rows arranged at a predetermined interval in the first direction, 4×n discharge hole rows of the plurality of discharge hole rows are arranged in a row in the second direction, one common flow path of the plurality of common flow paths is connected, via the plurality of pressure applying chambers, to the plurality of discharge holes belonging to the plurality of discharge hole rows, comprising two rows arranged along each side of the one common flow path, the plurality of discharge hole rows, connected to an f-th line common flow path of the plurality of common flow paths (f is every one of 1, 2, . . . , n), are, in order of arrangement in the second direction, an 4×f−3-th discharge hole row, an 4×f−2-th discharge hole row, an 4×f−1-th discharge hole row, and an 4×f-th discharge hole row, and the plurality of discharge holes belonging to the corresponding discharge hole row of the plurality of discharge hole rows are an 4×f−3-th row discharge hole, an 4×f−2-th row discharge hole, an 4×f−1-th row discharge hole, and an 4×f-th row discharge hole, four discharge hole rows of the plurality of discharge hole rows provided between the g-th line common flow path (g is every one of 1, 2, . . . , n−1) and the g+1-th line common flow path are collectively a g-th discharge hole group, and the plurality of discharge holes belonging to the g-th discharge hole group are g-group discharge holes, an h-th row discharge hole of the plurality of discharge holes (h is every one of 3, 5, 7, . . . , 4×n−3) and an h+1-th row discharge hole of the plurality of discharge holes located closest to the h-th row discharge hole are located with 2×n−1 discharge holes of the plurality of discharge holes interposed therebetween in the first direction, the i-th row discharge hole of the plurality of discharge holes (i is every one of 4, 8, 12, . . . , 4×(n−1)) and the i+1-th row discharge hole of the plurality of discharge holes located closest to the i-th row discharge hole are located with n−1 discharge holes interposed therebetween in the first direction, and a first-row discharge hole, a second-row discharge hole, a 4×n−1-th row discharge hole, and a 4×n-th row discharge hole are located adjacent to an (n−1)/2-th group discharge hole and an (n+1)/2-th group discharge hole.

5. The liquid discharge head according to claim 4, wherein in a planar view the plurality of discharge holes includes, the k1-th row discharge holes (k1 is every one of 3, 7, 11, . . . , 4×n−5) are arranged in a k1 row in a third direction that intersects with the first direction, the k2-th row discharge holes (k2 is every one of 4, 8, 12, . . . , 4×n−4) are arranged in a k2 row in the third direction, the k3-th row discharge holes (k3 is every one of 5, 9, 13, . . . , 4×n−3) are arranged in a k3 row in the third direction, and the k4-th row discharge holes (k4 is every one of 6, 10, 14, . . . , 4×n−2) are arranged in a k4 row in the third direction.

6. The liquid discharge head according to claim 1, wherein in a planar view, the plurality of common flow paths comprises n common flow paths, where n is any one of even numbers equal to or more than four, the n common flow paths are, in order of arrangement in the second direction, a first-line common flow path, a second-line common flow path, . . . , and an n-th line common flow path, the plurality of discharge holes form a plurality of discharge hole rows arranged at a predetermined interval in the first direction, 4×n discharge hole rows of the plurality of discharge hole rows are arranged in a row in the second direction, one common flow path of the plurality of common flow paths is connected, via the plurality of pressure applying chambers, to the plurality of discharge holes belonging to the plurality of discharge hole rows, comprising two rows arranged along each side of the one common flow path, the plurality of discharge hole rows, connected to an f-th line common flow path of the plurality of common flow paths (f is every one of 1, 2, . . . , n), are, in order of arrangement in the second direction, an 4×f−3-th discharge hole row, an 4×f−2-th discharge hole row, an 4×f−1-th discharge hole row, and an 4×f-th discharge hole row, and the plurality of discharge holes belonging to the corresponding discharge hole row of the plurality of discharge hole rows are an 4×f−3-th row discharge hole, an 4×f−2-th row discharge hole, an 4×f−1-th row discharge hole, and an 4×f-th row discharge hole, four discharge hole rows of the plurality of discharge hole rows provided between the g-th line common flow path (g is every one of 1, 2, . . . , n−1) and the g+1-th line common flow path are collectively a g-th discharge hole group, and the plurality of discharge holes belonging to the g-th discharge hole group are g-group discharge holes, an h-th row discharge hole of the plurality of discharge holes (h is every one of 3, 5, 7, . . . , 4×n−3) and an h+1-th row discharge hole of the plurality of discharge holes located closest to the h-th row discharge hole are located with 2×n−1 discharge holes of the plurality of discharge holes interposed therebetween in the first direction, the i-th row discharge hole of the plurality of discharge holes (i is every one of 4, 8, 12, . . . , 4×(n−1)) and the i+1-th row discharge hole of the plurality of discharge holes located closest to the i-th row discharge hole are located with n−2 or n discharge holes interposed therebetween in the first direction, a first-row discharge hole and a second-row discharge hole are located adjacent to each other in the first direction, a pair of the first-row discharge hole and the second-row discharge hole are located adjacent to an n/2-th group discharge hole and any of an n/2−1-th group discharge hole and an n/2+1-th group discharge hole, a 4×n−1-th row discharge hole and a 4×n-th row discharge hole are located adjacent to each other in the first direction, and a pair of the 4×n−1-th row discharge hole and the 4×n-th row discharge hole are located adjacent to an n/2-th group discharge hole and any of an n/2−1-th group discharge hole and an n/2+1-th group discharge hole.

7. The liquid discharge head according to claim 6, wherein in a planar view the plurality of discharge holes includes, the k1-th row discharge holes (k1 is every one of 3, 7, 11, . . . , 4×n−5) are arranged in a k1 row in a third direction that intersects with the first direction, the k2-th row discharge holes (k2 is every one of 4, 8, 12, . . . , 4×n−4) are arranged in a k2 row in the third direction, the k3-th row discharge holes (k3 is every one of 5, 9, 13, . . . , 4×n−3) are arranged in a k3 row in the third direction, and the k4-th row discharge holes (k4 is every one of 6, 10, 14, . . . , 4×n−2) are arranged in a k4 row in the third direction.

8. The liquid discharge head according to claim 1, wherein in a planar view, the plurality of common flow paths comprises n common flow paths, where n is any one of odd numbers equal to or more than five, the n common flow paths are, in order of arrangement in the second direction, a first-line common flow path, a second-line common flow path, . . . , and an n-th line common flow path, the plurality of discharge holes form a plurality of discharge hole rows arranged at a predetermined interval in the first direction, 4×n discharge hole rows of the plurality of discharge hole rows are arranged in a row in the second direction, one common flow path of the plurality of common flow paths is connected, via the plurality of pressure applying chambers, to the plurality of discharge holes belonging to the plurality of discharge hole rows, comprising two rows arranged along each side of the one common flow path, the plurality of discharge hole rows, connected to an f-th line common flow path of the plurality of common flow paths (f is every one of 1, 2, . . . , n), are, in order of arrangement in the second direction, an 4×f−3-th discharge hole row, an 4×f−2-th discharge hole row, an 4×f−1-th discharge hole row, and an 4×f-th discharge hole row, and the plurality of discharge holes belonging to the corresponding discharge hole row of the plurality of discharge hole rows are an 4×f−3-th row discharge hole, an 4×f−2-th row discharge hole, an 4×f−1-th row discharge hole, and an 4×f-th row discharge hole, four discharge hole rows of the plurality of discharge hole rows provided between the g-th line common flow path (g is every one of 1, 2, . . . , n−1) and the g+1-th line common flow path are collectively a g-th discharge hole group, and the plurality of discharge holes belonging to the g-th discharge hole group are g-group discharge holes, an h-th row discharge hole of the plurality of discharge holes (h is every one of 3, 5, 7, . . . , 4×n−3) and an h+1-th row discharge hole of the plurality of discharge holes located closest to the h-th row discharge hole are located with 2×n−1 discharge holes of the plurality of discharge holes interposed therebetween in the first direction, the i-th row discharge hole of the plurality of discharge holes (i is every one of 4, 8, 12, . . . , 4×(n−1)) and the i+1-th row discharge hole of the plurality of discharge holes located closest to the i-th row discharge hole are located with n−2 or n discharge holes interposed therebetween in the first direction, a first-row discharge hole and a second-row discharge hole are located adjacent to each other in the first direction, a pair of the first-row discharge hole and the second-row discharge hole are located adjacent to an (n−1)/2-th group discharge hole and an (n+1)/2-th group discharge hole, a 4×n−1-th row discharge hole and a 4×n-th row discharge hole are located adjacent to each other in the first direction, and a pair of the 4×n−1-th row discharge hole and the 4×n-th row discharge hole are located adjacent to an (n−1)/2-th group discharge hole and an (n+1)/2-th group discharge hole.

9. The liquid discharge head according to claim 8, wherein in a planar view the plurality of discharge holes includes, the k1-th row discharge holes (k1 is every one of 3, 7, 11, . . . , 4×n−5) are arranged in a k1 row in a third direction that intersects with the first direction, the k2-th row discharge holes (k2 is every one of 4, 8, 12, . . . , 4×n−4) are arranged in a k2 row in the third direction, the k3-th row discharge holes (k3 is every one of 5, 9, 13, . . . , 4×n−3) are arranged in a k3 row in the third direction, and the k4-th row discharge holes (k4 is every one of 6, 10, 14, . . . , 4×n−2) are arranged in a k4 row in the third direction.

10. The liquid discharge head according to claim 1, wherein in a planar view, when one of the discharge holes located adjacent to each other in the first direction is the j1-th group discharge hole and another one is the j2-th group discharge hole (here, j1<j2), j2-j1=1 or j1=1 and j2=n−1.

11. The liquid discharge head according to claim 10, wherein in a planar view the plurality of discharge holes includes, the k1-th row discharge holes (k1 is every one of 3, 7, 11, . . . , 4×n−5) are arranged in a k1 row in a third direction that intersects with the first direction, the k2-th row discharge holes (k2 is every one of 4, 8, 12, . . . , 4×n−4) are arranged in a k2 row in the third direction, the k3-th row discharge holes (k3 is every one of 5, 9, 13, . . . , 4×n−3) are arranged in a k3 row in the third direction, and the k4-th row discharge holes (k4 is every one of 6, 10, 14, . . . , 4×n−2) are arranged in a k4 row in the third direction.

12. The liquid discharge head according to claim 1, wherein in a planar view the plurality of discharge holes includes, the k1-th row discharge holes (k1 is every one of 3, 7, 11, . . . , 4×n−5) are arranged in a k1 row in a third direction that intersects with the first direction, the k2-th row discharge holes (k2 is every one of 4, 8, 12, . . . , 4×n−4) are arranged in a k2 row in the third direction, the k3-th row discharge holes (k3 is every one of 5, 9, 13, . . . , 4×n−3) are arranged in a k3 row in the third direction, and the k4-th row discharge holes (k4 is every one of 6, 10, 14, . . . , 4×n−2) are arranged in a k4 row in the third direction.

13. A recording apparatus comprising:

the liquid discharge head according to claim 1;

a conveying module that conveys a recording medium to the liquid discharge head; and a controller that controls the liquid discharge head.

* * * * *